US007860428B2

(12) United States Patent
Kurita et al.

(10) Patent No.: US 7,860,428 B2
(45) Date of Patent: Dec. 28, 2010

(54) DETACHABLE HOLDING PORTIONS IN AN IMAGE FORMING APPARATUS

(75) Inventors: Tomokazu Kurita, Kanagawa (JP); Junichi Ozawa, Kanagawa (JP); Ryota Kubo, Kanagawa (JP); Mitsuhiro Matsumoto, Kanagawa (JP); Shigeo Ohno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 611 days.

(21) Appl. No.: 11/727,732

(22) Filed: Mar. 28, 2007

(65) Prior Publication Data

US 2007/0269234 A1 Nov. 22, 2007

(30) Foreign Application Priority Data

May 16, 2006 (JP) ..... 2006-136203
Jul. 13, 2006 (JP) ..... 2006-192653

(51) Int. Cl.
*G03G 15/02* (2006.01)
*G03G 21/18* (2006.01)

(52) U.S. Cl. ..... 399/100; 399/113; 399/115

(58) Field of Classification Search ..... 399/100, 399/101, 111, 113, 115, 176
See application file for complete search history.

(56) References Cited

U.S. PATENT DOCUMENTS 5,572,293 A * 11/1996 Kikuchi et al. ..... 399/357
5,697,020 A * 12/1997 Sato et al. ..... 399/100
6,334,034 B1 * 12/2001 Kitazawa et al. ..... 399/100
7,460,810 B2 * 12/2008 Sampe et al. ..... 399/100
7,463,845 B2 * 12/2008 Suda et al. ..... 399/115
7,496,323 B2 * 2/2009 Kataoka et al. ..... 399/346
2007/0146826 A1 6/2007 Inao et al. ..... 358/4.98

FOREIGN PATENT DOCUMENTS

EP 1 288 738 A2 3/2003
JP 2-257146 A 10/1990
JP 05-297690 11/1993
JP 2000-162853 6/2000
JP 2000242063 A * 9/2000
JP 2004-4749 1/2004
JP 2004085987 A * 3/2004
JP 2005-331686 12/2005
JP 2006011269 A * 1/2006
KR 10-2005-0106653 11/2005

* cited by examiner

*Primary Examiner*—Robert Beatty
(74) *Attorney, Agent, or Firm*—Morgan, Lewis & Bockus LLP

(57) ABSTRACT

There is provided an image forming apparatus including: an image carrier carrying an image; a charging roll charging the image carrier; a cleaning member configured to be brought into contact with the charging roll for cleaning the charging roll; a first holding portion detachably provided in an apparatus main body for holding the image carrier; and a second holding portion provided within the apparatus main body independently from the first holding portion, for holding the cleaning member.

14 Claims, 22 Drawing Sheets

52
110
114
116
112
120
118
12
122
124
108

DETACHABLE HOLDING PORTIONS IN AN IMAGE FORMING APPARATUS

CROSS-REFERENCE TO RELATED APPLICATIONS

This application is based on and claims priority under 35 USC 119 from Japanese Patent Application Nos. 2006-136203 filed on May 16, 2006 and 2006-192653 filed on Jul. 13, 2006.

BACKGROUND

1. Technical Field

The present invention relates to an image forming apparatus provided with a charging roll, and a cleaning roll cleaning the charging roll.

2. Related Art

Since the charging roll charging a surface of a photosensitive body is directly brought into contact with the photosensitive body, extraneous material remaining on the surface of the photosensitive body tends to be attached to the surface of the charging roll. If the extraneous material is attached to the surface of the charging roll, a charge defect is caused.

Accordingly, dirt on the surface of the charging roll is removed by bringing a cleaning member, which is constituted by a brush or a sponge, into contact with the surface of the charging roll.

SUMMARY

In accordance with a first aspect of the present invention, there is provided an image forming apparatus including: an image carrier carrying an image; a charging roll charging the image carrier; a cleaning member configured to be brought into contact with the charging roll for cleaning the charging roll; a first holding portion detachably provided in an apparatus main body for holding the image carrier; and a second holding portion provided within the apparatus main body independently from the first holding portion, for holding the cleaning member.

BRIEF DESCRIPTION OF THE DRAWINGS

Exemplary embodiments of the present invention will be described in detail based on the following figures, wherein.

DETAILED DESCRIPTION

First Exemplary Embodiment

A description will be given below of an image forming apparatus in accordance with a first exemplary embodiment of the present invention with reference to the accompanying drawings.

Figure 1:
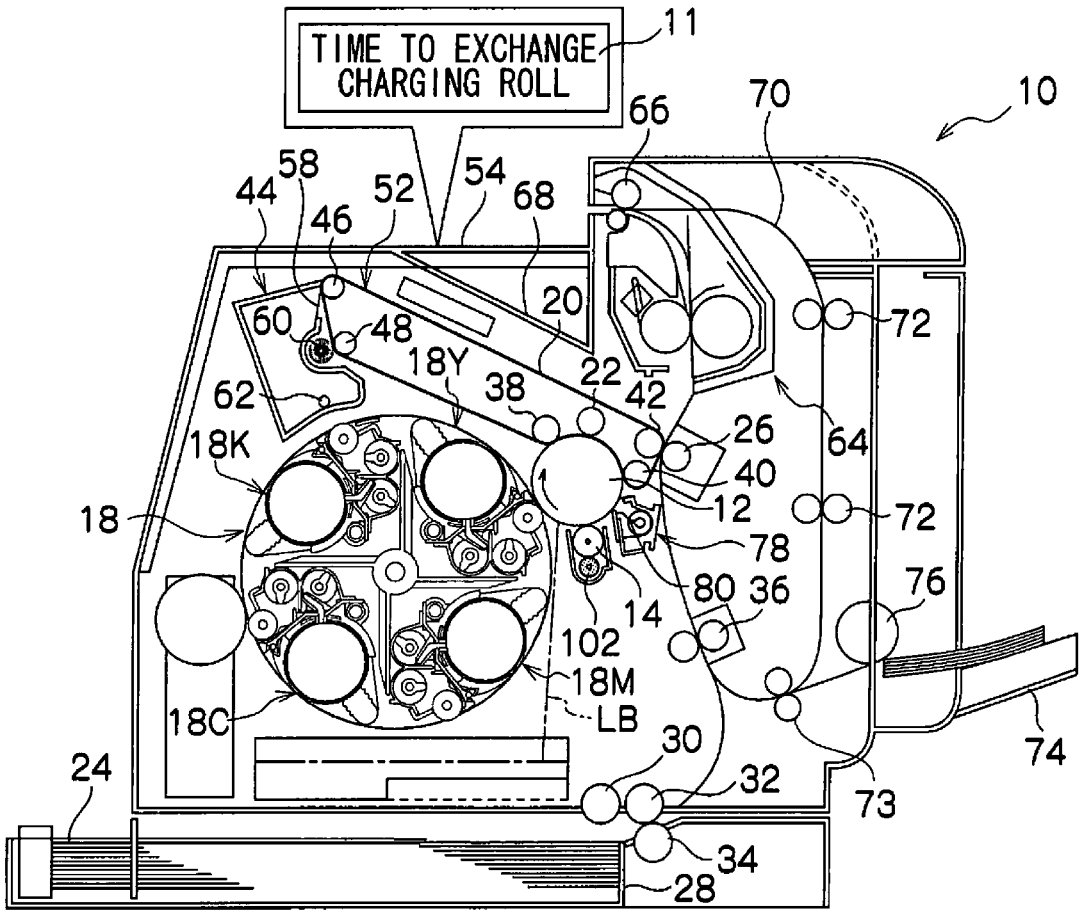
FIG. 1 is a schematic view of a structure of an image forming apparatus in accordance with a first exemplary embodiment of the invention.

An image forming apparatus 10 in accordance with the present embodiment shown in FIG. 1 corresponds to a four-cycle type full-color laser printer, and is structured, as illustrated, such that a photosensitive drum 12 (an image carrier) is rotatably arranged in a slightly right upper portion from a center within the apparatus. As the photosensitive drum 12, there is employed a structure constituted, for example, by a conductive cylinder body having a diameter of about 47 mm, the surface of which is covered with a photosensitive layer made of an OPC or the like, and the photosensitive drum 12 is rotationally driven at a process speed of about 150 mm/sec along a direction of an arrow, by a motor (not shown).

After the surface of the photosensitive drum 12 is charged at a predetermined electric potential by a charging roll 14 arranged approximately just below the photosensitive drum 12, image exposure by a laser beam LB is conducted on the surface of the photosensitive drum 12 by an exposure apparatus 16 arranged below the charging roll 14, whereby an electrostatic latent image is formed in correspondence to image information.

The electrostatic latent image formed on the photosensitive drum 12 is developed by a rotary type developing device 18 in which respective color developing devices 18Y, 18M, 18C and 18K of yellow (Y), magenta (M), cyan (C) and black (K) are arranged along a peripheral direction, thereby forming a predetermined colored toner image.

At this time, respective steps of charging, exposing and developing are repeated at a predetermined frequency in correspondence to the color of the image to be formed. In the developing step, the rotary type developing device 18 is rotated, and the developing devices 18Y, 18M, 18C and 18K of the corresponding colors are moved to developing positions facing the photosensitive drum 12.

For example, in the case of forming a full-color image, the respective steps of charging, exposing and developing are repeated on the surface of the photosensitive drum 12 four times in correspondence to the respective colors of yellow (Y), magenta (M), cyan (C) and black (K), and the toner images corresponding to the respective colors of yellow (Y), magenta (M), cyan (C) and black (K) are sequentially formed on the surface of the photosensitive drum 12. A frequency at which the photosensitive drum 12 is rotated in the case that the toner image is formed, is different in correspondence to a size of the image. For example, in the case of A4 size, one image is formed by three rotations of the photosensitive drum 12. In other words, the toner images corresponding to the respective colors of yellow (Y), magenta (M), cyan (C) and black (K) are formed on the surface of the photosensitive drum 12 every three rotations of the photosensitive drum 12.

The respective color toner images of yellow (Y), magenta (M), cyan (C) and black (K) sequentially formed on the photosensitive drum 12 are transferred by a first transfer roll 22 in a state being superimposed on an intermediate transfer belt 20, at a first transfer position at which an intermediate transfer belt 20 is wound around an outer periphery of the photosensitive drum 12.

The toner images of yellow (Y), magenta (M), cyan (C) and black (K) transferred on the intermediate transfer belt 20 in a multiple manner are transferred by a second transfer roll 26 in a lump on a recording paper 24 fed at a predetermined timing.

On the other hand, the recording paper 24 is fed out by a pickup roll 30 from a paper feed cassette 28 arranged in a lower portion of the image forming apparatus 10, is fed in a state being separated one by one by a feed roll 32 and a retard roll 34, and is transported to the second transfer position of the intermediate transfer belt 20 in a state being synchronized with the toner image transferred on the intermediate transfer belt 20 by a registration roll 36.

The intermediate transfer belt 20 is tensioned at a predetermined tension by a wrap-in roll 38 specifying a wrap position of the intermediate transfer belt 20 in an upstream side in a rotating direction of the photosensitive drum 12, the first transfer roll 22 transferring the toner image formed on the photosensitive drum 12 onto the intermediate transfer belt 20, a wrap-out roll 40 specifying the wrap position of the intermediate transfer belt 20 in a downstream side of the wrap position, a backup roll 42 brought into contact with the second transfer roll 26 via the intermediate transfer belt 20, a first cleaning backup roll 46 facing a cleaning apparatus 44 of the intermediate transfer belt 20, and a second cleaning backup roll 48, and is driven in such a manner as to move in a circulation manner at a predetermined process speed (about 150 mm/sec), for example, in accordance with a rotation of the photosensitive drum 12.

In order to downsize the image forming apparatus 10, the intermediate transfer belt 20 is structured such that a cross sectional shape to which the intermediate transfer belt 20 is tensioned comes to an approximately flat narrowed trapezoidal shape.

Figure 2:
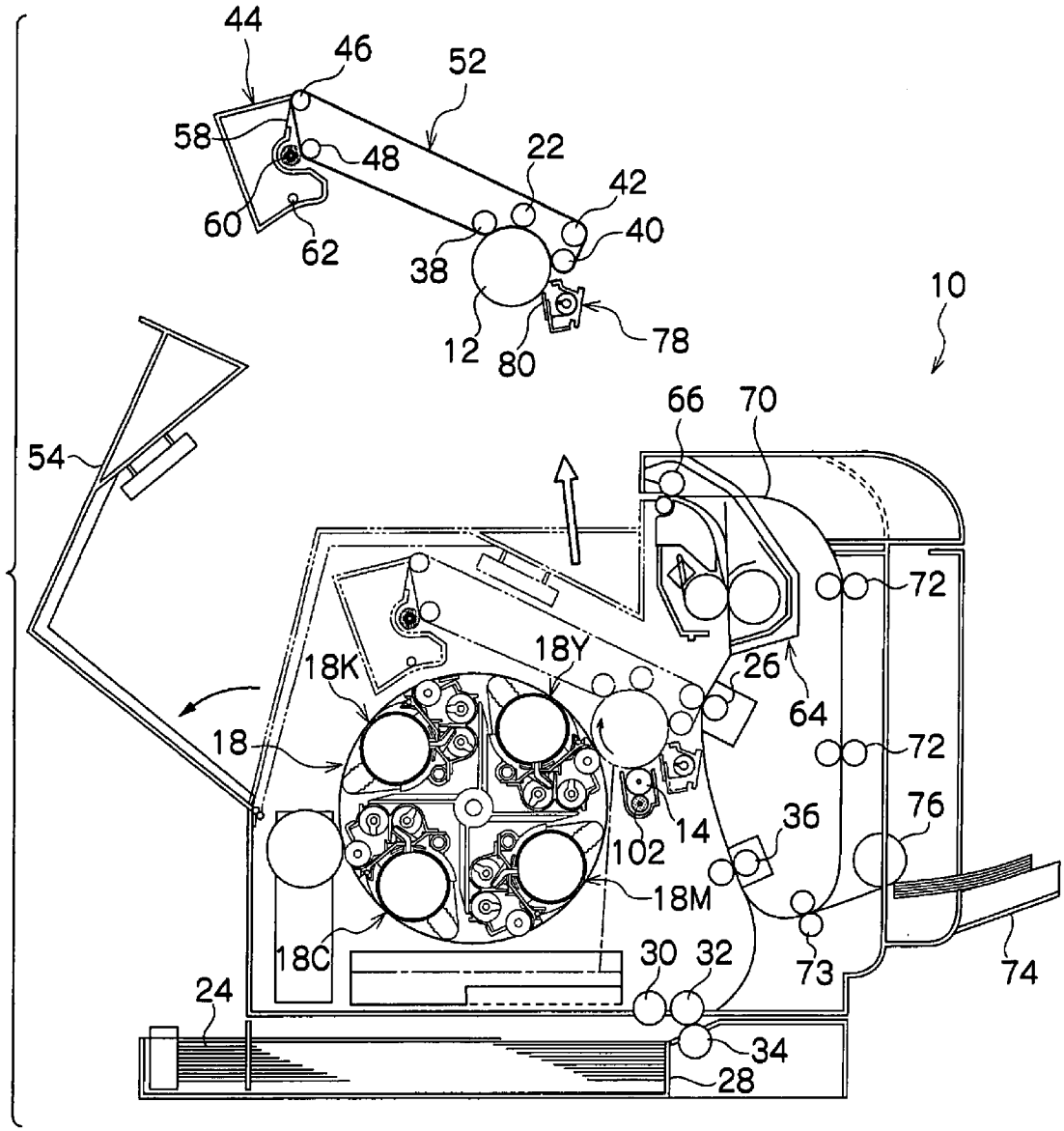
FIG. 2 is a schematic view showing a state in which an image forming unit including a photosensitive drum is taken out from the image forming apparatus.

The intermediate transfer belt 20 is provided in an image forming unit 52. The image forming unit 52 is constituted by the photosensitive drum 12, the intermediate transfer belt 20, plural rolls 22, 38, 40, 42, 46 and 48 (first transfer rolls) tensioning the intermediate transfer belt 20, a cleaning apparatus 44 for the intermediate transfer belt 20, and a cleaning apparatus 78 to be mentioned below for the photosensitive drum 12. Further, as shown in FIG. 2, an entire of the image forming unit 52 can be detached from the image forming apparatus 10 by opening an upper cover 54 of the image forming apparatus 10, and taking up a handle (not shown) provided in an upper portion of the image forming unit 52 by a hand, as shown in FIG. 2.

Further, the photosensitive drum 12 is structured so as to be attached to and detached from the image forming unit 52 in a state in which the image forming unit 52 is detached from the image forming apparatus 10 main body. Accordingly, it is possible to independently replace a photosensitive body unit 98 and the intermediate transfer belt 20 in correspondence to their respective service lives. A mounting structure of the photosensitive drum 12 will be described below.

On the other hand, the cleaning apparatus 44 of the intermediate transfer belt 20 has a scraper 58 arranged so as to be brought into contact with the surface of the intermediate transfer belt 20 tensioned by the first cleaning backup roll 46, and a cleaning brush 60 arranged so as to be pressure contacted with the surface of the intermediate transfer belt 20 tensioned by the second cleaning backup roll 48, and residual toner, paper powder and the like removed by the scraper 58 and the cleaning brush 60 are recovered in an inner portion of the cleaning apparatus 44.

The cleaning apparatus 44 is arranged so as to freely oscillate around an oscillation shaft 62 in a counterclockwise direction in the drawing, and is structured so as to be retracted at a position away from the surface of the intermediate transfer belt 20 until a second transfer of the final color toner image is finished, and be brought into contact with the surface of the intermediate transfer belt 20 when the second transfer of the final color toner image is finished.

Further, the recording paper 24, to which the toner image is transferred from the intermediate transfer belt 20, is transported to a fixing apparatus 64, and is heated and pressurized by the fixing apparatus 64, whereby the toner image is fixed on the recording paper 24. Thereafter, in the case of a single-sided print, the recording paper 24, to which the toner image is fixed, is output directly to an output tray 68 provided in an upper portion of the image forming apparatus 10 by an output roll 66.

On the other hand, in the case of a double-sided print, the output roll 66 is inverted so as to switch a transportation route of the recording paper 24 to a paper transport path 70 for the double-side print, while pinching a rear end portion of the recording paper 24, but does not directly output the recording paper 24 in which the toner image is fixed to a first surface (a front surface) by the fixing apparatus 64 onto the output tray 68. Further, in a state the front and back surfaces of the recording paper 24 is inverted by a transport roll 72 arranged in the paper transport path 70 for the double-side print, the recording paper is transported to the second transfer position of the intermediate transfer belt 20, and the toner image is transferred on a second surface (a back surface) of the recording paper 24. Further, the toner image on the second surface (the back surface) of the recording paper 24 is fixed by the fixing apparatus 64, and the recording paper 24 is output onto the output tray 68.

Further, a manual tray 74 can be optionally installed to one of side surfaces of the image forming apparatus 10 so as to be openable and closable. An optional size and kind of recording paper 24 mounted on the manual tray 74 is fed by the paper feed roll 76, and is transported to the second transfer position of the intermediate transfer belt 20 via the transport roll 73 and the registration roll 36, whereby it is possible to form the image on the optional size and kind of recording paper 24.

After the step of transferring the toner image is finished, residual toner, paper powder and the like are removed from the surface of the photosensitive drum 12 by a cleaning blade 80 of the cleaning apparatus 78 arranged at a diagonally lower side of the photosensitive drum 12, each time that the photosensitive drum 12 turns one revolution, and the surface of the photosensitive drum 12 is prepared for the next image forming step.

Figure 3:
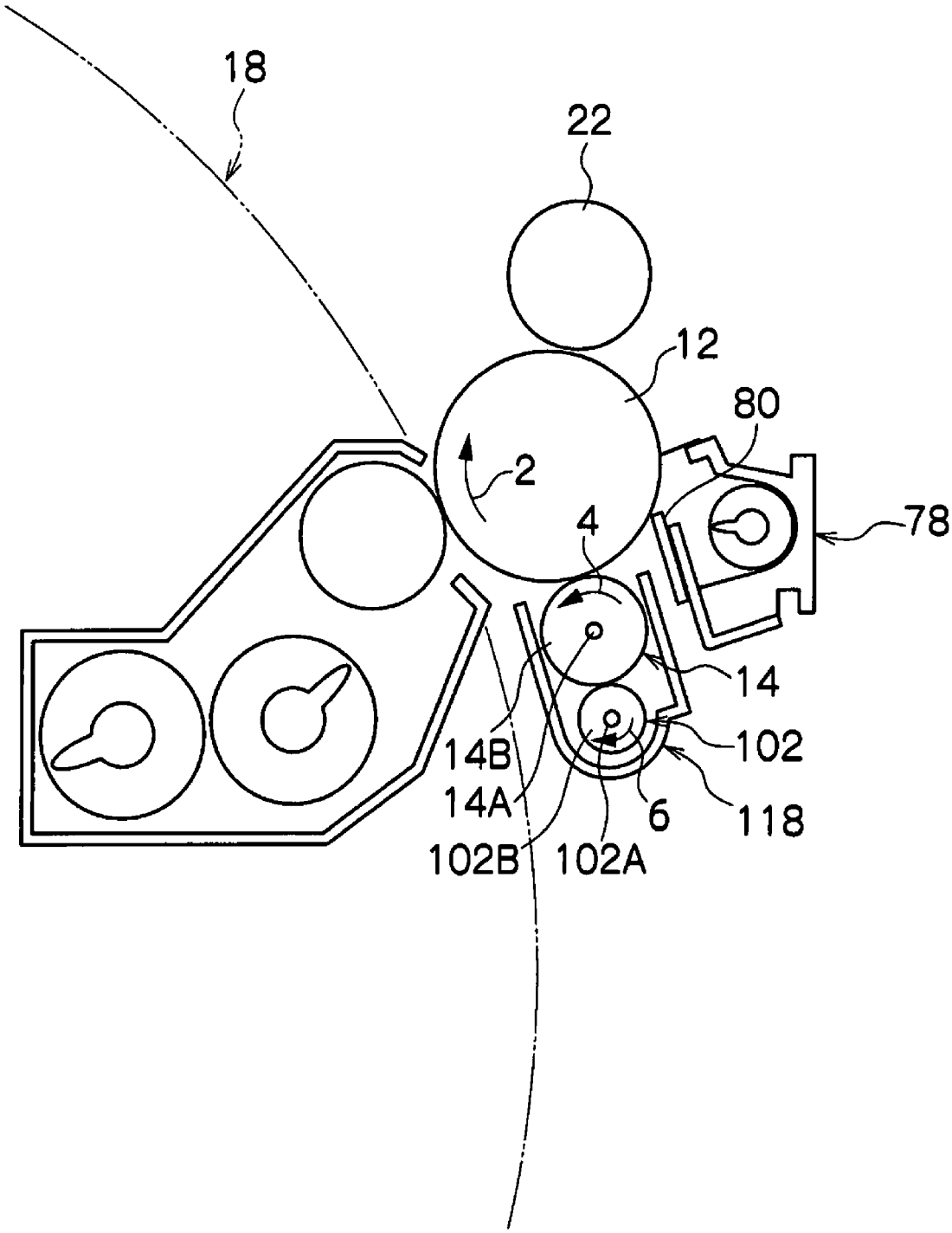
FIG. 3 is an enlarged view showing structures of the photosensitive drum, a charging roll and a cleaning roll mounted in the image forming apparatus.

As shown in FIG. 3, the charging roll 14 is arranged in a lower portion of the photosensitive drum 12 in such a manner as to be brought into contact with the photosensitive drum 12. The charging roll 14 is structured such that a charged layer 14B is formed around a conductive shaft 14A, and the shaft 14A is rotatably supported to a housing 118 to be mentioned below.

A roll-shaped cleaning roll 102 brought into contact with the surface of the charging roll 14 is provided in a lower side in an opposite side to the photosensitive drum 12 of the charging roll 14. The cleaning roll 102 is structured such that a sponge layer 102B is formed around a shaft 102A, and the shaft 102A is rotatably supported to the housing 118.

The cleaning roll 102 is pressed to the charging roll 14 by a predetermined load, and the sponge layer 102B is elastically deformed along a peripheral surface of the charging roll 14 so as to form a nip portion N.

The photosensitive drum 12 is rotationally driven in a clockwise direction in FIG. 3 (a direction of an arrow 2) by a motor (not shown), and the charging roll 14 is rotated in a direction of an arrow 4 due to the rotation of the photosensitive drum 12. Further, the roll-shaped cleaning roll 102 is rotated due to the rotation of the charging roll 14. A description will be given later of a mounting structure of the charging roll 14 and the cleaning roll 102.

Since the cleaning roll 102 is rotated due to the rotation of the photosensitive drum 12, contamination (the extraneous material) such as the toner, an external additive or the like attached to the surface of the charging roll 14 can be cleaned by the cleaning roll 102. Further, it is considered that if the extraneous material is incorporated in a cell of the sponge layer 102B, and the extraneous material collected within the cell aggregates so as to reach a certain size, the extraneous material is returned to the photosensitive drum 12 via the charging roll 14 from the cleaning roll 102, and is collected by the cleaning apparatus 78 cleaning the photosensitive drum 12, whereby a cleaning performance is maintained.

With respect to the cleaning roll 102, a free machining steel, a stainless steel or the like is used as a material of the shaft 102A, and a material and a surface treatment method are properly selected in correspondence to an intended use such as a sliding performance or the like. Further, a material having no conductivity may be processed by a general process such as a plating process or the like, whereby a conductive treatment may be executed, or may be, of course, used as it is. Further, since the cleaning roll 102 is brought into contact with the charging roll 14 via the sponge layer 102B at a suitable nip pressure, the cleaning roll 102 selects a material having such a strength as to have a reduced deflection at a time of nipping or a shaft diameter having a sufficient rigidity with respect to a shaft length.

The sponge layer 102B is formed in a cylindrical shape, and is constituted by a foam material having a three-dimensional porous structure. The sponge layer 102B is selected by a foam resin such as a polyurethane, a polyethylene, a polyamide, a polypropylene or the like, or a rubber material. The sponge layer 102B particularly preferably employs a polyurethane which has an excellent tear strength, tensile strength or the like, for the purpose of preventing the surface of the charging roll 14 from being scratched by a friction of the sponge layer 102B or preventing tearing or breakage over a long period of time, while efficiently cleaning the extraneous material such as the external additive or the like on the basis of the driven slide friction with the charging roll 14. The cleaning member of the cleaning roll 102 may be constituted by a blade, a brush, a waste or the like, in addition to the sponge.

Further, the charging roll 14 is structured such that a conductive elastic layer and a surface layer are sequentially formed as the charged layer 14B on the conductive shaft 14A.

The free machining steel, the stainless steel or the like is used as the material of the shaft 14A, a material and a surface treatment method are properly selected in correspondence to an intended use such as a sliding performance or the like, and a non-conductive material may be processed by a general process such as a plating process or the like, whereby a conductive treatment may be executed.

In the conductive elastic layer constituting the charged layer 14B of the charging roll 14, it is possible to add a material normally added to the rubber, for example, an elastic material such as a rubber or the like having an elasticity, a conductive material such as a carbon black and an ion conductive material or the like adjusting a resistance of the conductive elastic layer, a filler such as a softening agent, a plasticizing material, a hardening agent, a vulcanizing agent, a vulcanizing accelerator, an antioxidant, filler such as a silica and a calcium carbonate or the like, as occasion demands. It is formed by coating a mixture obtained by adding the material normally added to the rubber on a peripheral surface of the conductive shaft 14A. As a conductive agent for the purpose of adjusting a resistance value, it is possible to employ a material in which an electrically conducting material by using an electron and/or an ion as an electric charge carrier is dispersed, such as the carbon black or the ion conductive agent blended in the matrix material. Further, the elastic material may be constituted by a foam body.

The surface layer constituting the charged layer 14B is formed for the purpose of preventing contamination by the extraneous material such as the toner or the like, and the material of the surface layer may employ any of the resin, the rubber and the like, and is not particularly limited. Examples thereof include a polyester, a polyimide, a copolymer nylon, a silicone resin, an acrylic resin, a polyvinyl butyral, an ethylene tetrafluoroethylene copolymer, a melamine resin, a fluorine-contained rubber, an epoxy resin, a polycarbonate, a polyvinyl alcohol, a cellulose, a polyvinylidene chloride, a polyvinyl chloride, a polyethylene, an ethylene-vinyl acetate copolymer or the like.

It is possible to contain the conductive material in the surface layer so as to adjust the resistance value. As the conductive material, it is desirable that a particle diameter is equal to or less than 3 μm.

Further, as the conductive agent for the purpose of adjusting the resistance value, it is possible to employ a material in which an electrically conducting material by using an electron and/or an ion as an electric charge carrier is dispersed, such as the carbon black, a conductive metallic oxide particle or the ion conductive agent blended in the matrix material.

The conductive metallic oxide particle corresponding to the conductive particle for adjusting the resistance value can employ any conductive agent as far as it is a conductive particle such as a tin oxide, a tin oxide doped by an antimony, a zinc oxide, an anatase-type titanium dioxide, an ITO or the like, and has the electron as the electric charge carrier, and is not particularly limited. They can be used alone or can be used in combination of two or more thereof. Although the particle may have any particle diameter as far as the invention is not obstructed, it is preferable to employ the tin oxide, the tin oxide doped by the antimony or the anatase-type titanium dioxide in view of the resistance value adjustment and the strength, and it is further preferable to employ the tin oxide or the tin oxide doped by the antimony.

Since the resistance control is executed by the above-mentioned conductive material, the resistance value of the surface layer is not changed in accordance with environmental conditions, and it is possible to obtain stable characteristics.

Further, the fluorine containing resin or the silicone containing resin is employed in the surface layer. In particular, it is preferable that the surface layer is structured by a fluorine modified acrylate polymer. Further, it is possible to add fine particle in the surface layer. Accordingly, the surface layer becomes hydrophobic and acts so as to prevent the extraneous material from being attached to the charging roll 14. Further, it is possible to improve an abrasion resistance between the charging roll 14 and the photosensitive drum 12 by adding an insulative particle such as an alumina or a silica, applying concavity and convexity to the surface of the charging roll 14, and reducing a load at the time of sliding against the photosensitive drum 12.

Next, a description will be given in detail of a mounting structure of the photosensitive drum 12 to the image forming unit 52.

Figure 4:
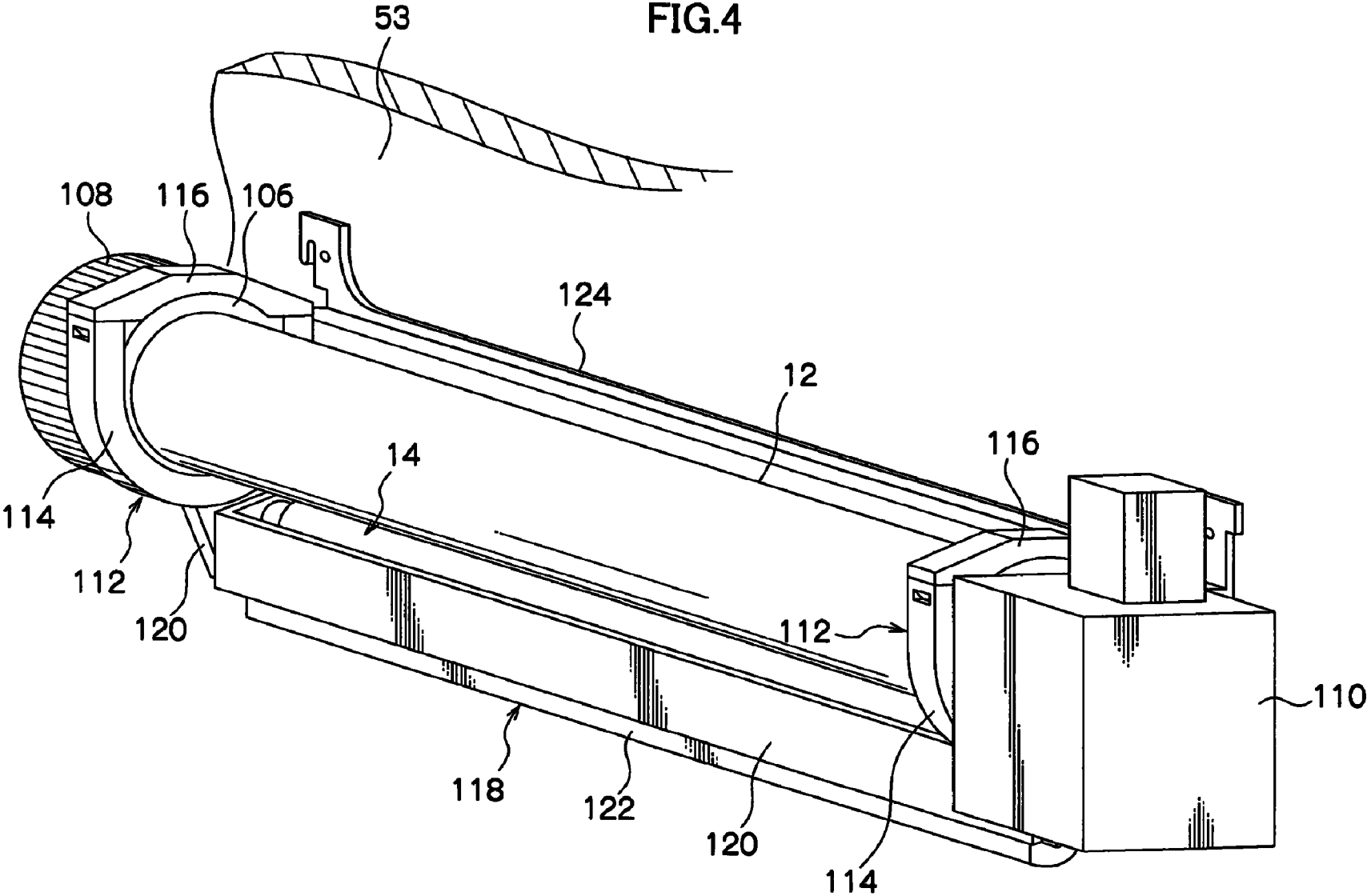
FIG. 4 is a perspective view showing a mounting structure of the photosensitive drum, the charging roll and the cleaning roll.
Figure 5:
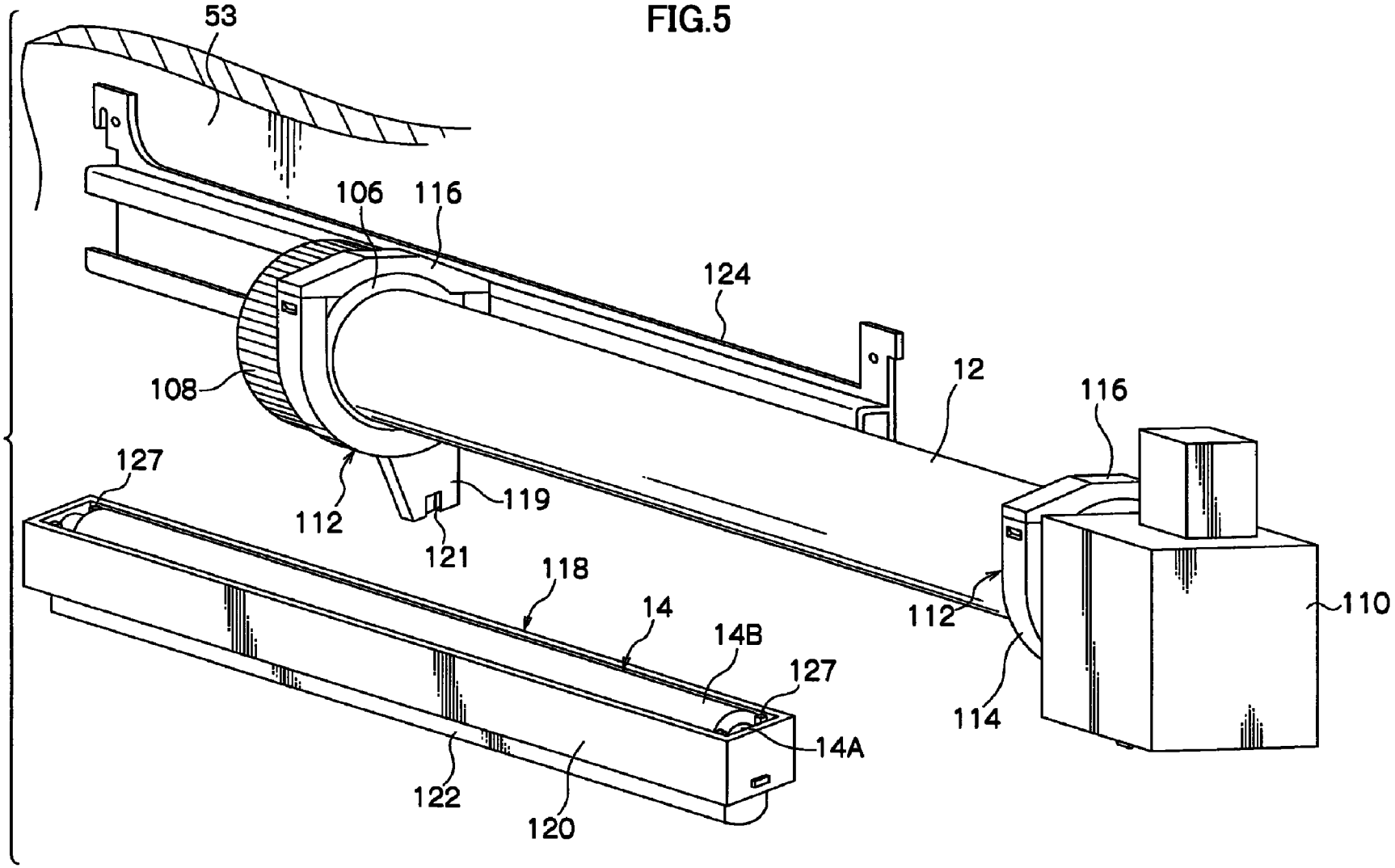
FIG. 5 is a perspective view showing the mounting structure of the photosensitive drum, the charging roll and the cleaning roll.

As shown in FIGS. 4 and 5, a rail 124 is attached to the frame 53 of the image forming unit 52 (refer to FIG. 1) in parallel with the shaft of the photosensitive drum 12. The structure is made such that engagement portions (not shown) of support members 112 arranged in both end portions of the photosensitive drum 12 are engaged with the rail 124. Accordingly, the photosensitive drum 12 is slidable right and left in the drawing along the rail 124.

The support member 112 is constituted by an approximately U-shaped receiving portion 114 supporting an outer peripheral surface of the bearing 106 provided in both end portions of the photosensitive drum 12, and a lid portion 116 closing an opening of the receiving portion 114 and pinching the bearing 106 with respect to the receiving portion 114. Accordingly, the photosensitive drum 12 is rotatably supported to the support member 112 via the bearing 106 in both ends.

A power source apparatus 110 is attached to one end portion (a right side in the drawing) of the photosensitive drum 12. An electric voltage is applied to the charging roll 14 by the power source apparatus 110 and the charging roll 14 is electrically charged. Further, a gear 108 is provided in the other end portion (a left side in the drawing) of the photosensitive drum 12. The gear 108 is engaged with a gear provided in a shaft of a drive motor (not shown) arranged in the image forming apparatus 10 main body (see FIG. 1). Accordingly, the structure is made such that the rotating force of the drive motor is transmitted to the photosensitive drum 12 via the gear 108.

On the other hand, a plate-like plate piece 119 is integrally provided in a lower surface of the receiving portion 114 of the support member 112. An approximately U-shaped groove 121 is formed near a lower end of the plate piece 119. A convex piece 128 provided in a housing 118 to be described below is engaged with the groove 121.

Figures 7A, 7B, 7C:
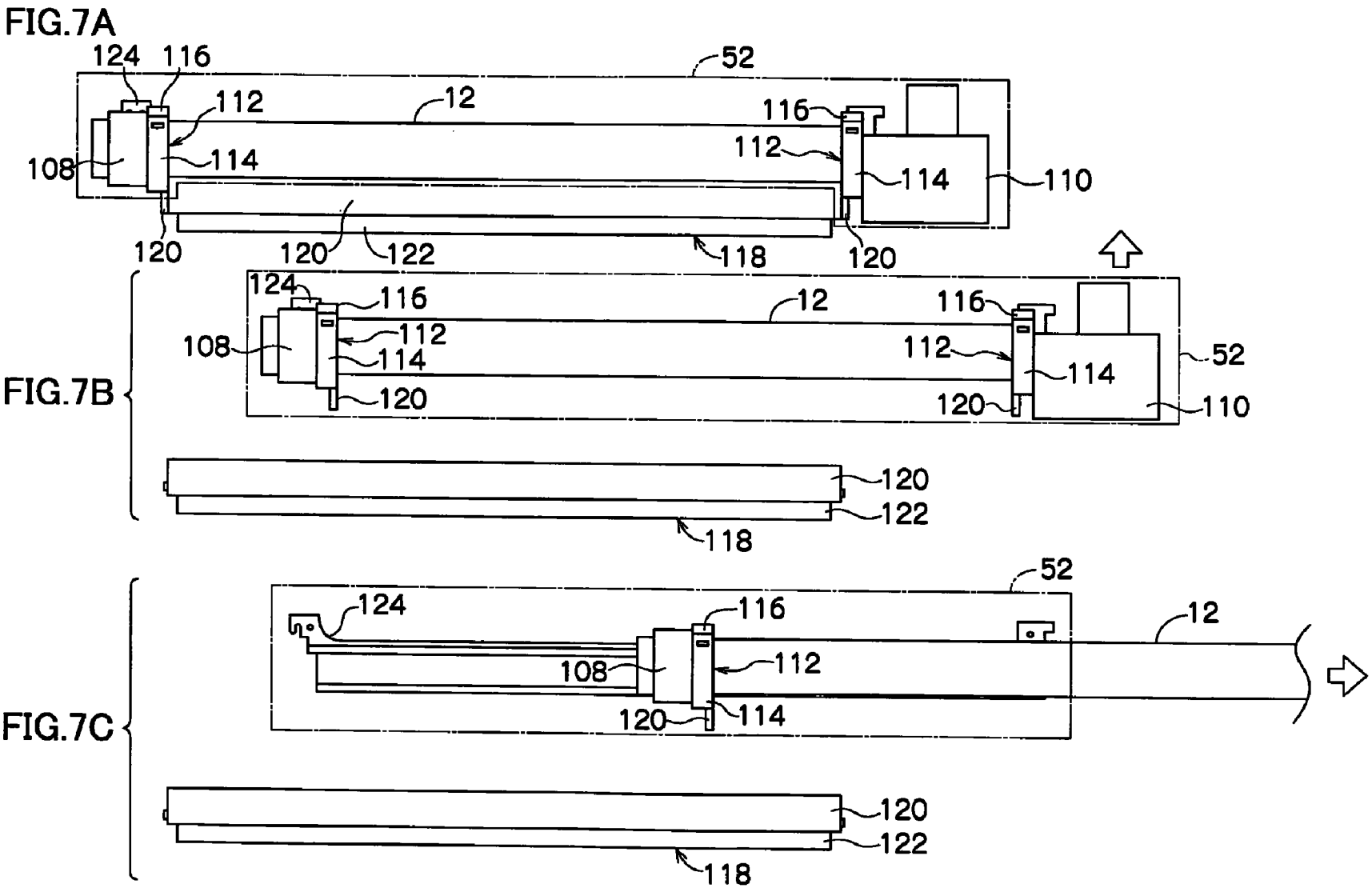
FIG. 7A is a side elevational view showing a positional relation between an image forming unit, and the charging roll and the cleaning roll, and shows a state in which the image forming unit is installed into the image forming apparatus.
FIG. 7B is a side elevational view showing the positional relation between the image forming unit, and the charging roll and the cleaning roll, and shows a state in which the image forming unit is taken out from the image forming apparatus.
FIG. 7C is a side elevational view showing the positional relation between the image forming unit, and the charging roll and the cleaning roll, and shows a state in which the photosensitive drum is detached from the image forming unit.
Figure 8A:
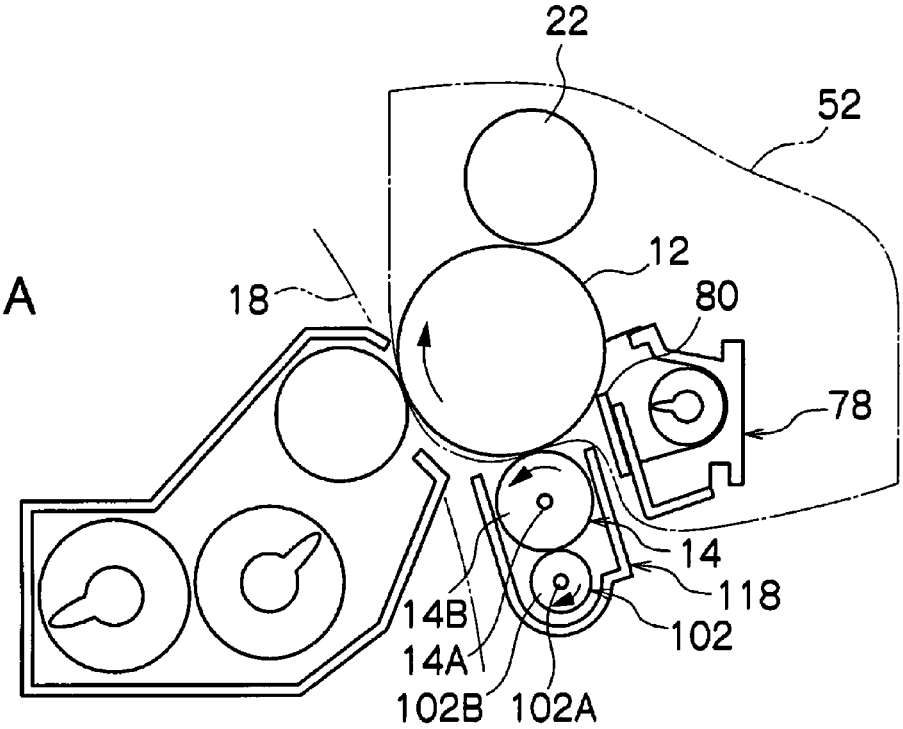
FIG. 8A is a side elevational view from an axial direction showing the positional relation between the image forming unit, and the charging roll and the cleaning roll, and shows a state in which the image forming unit is installed into the image forming apparatus.
Figure 8B:
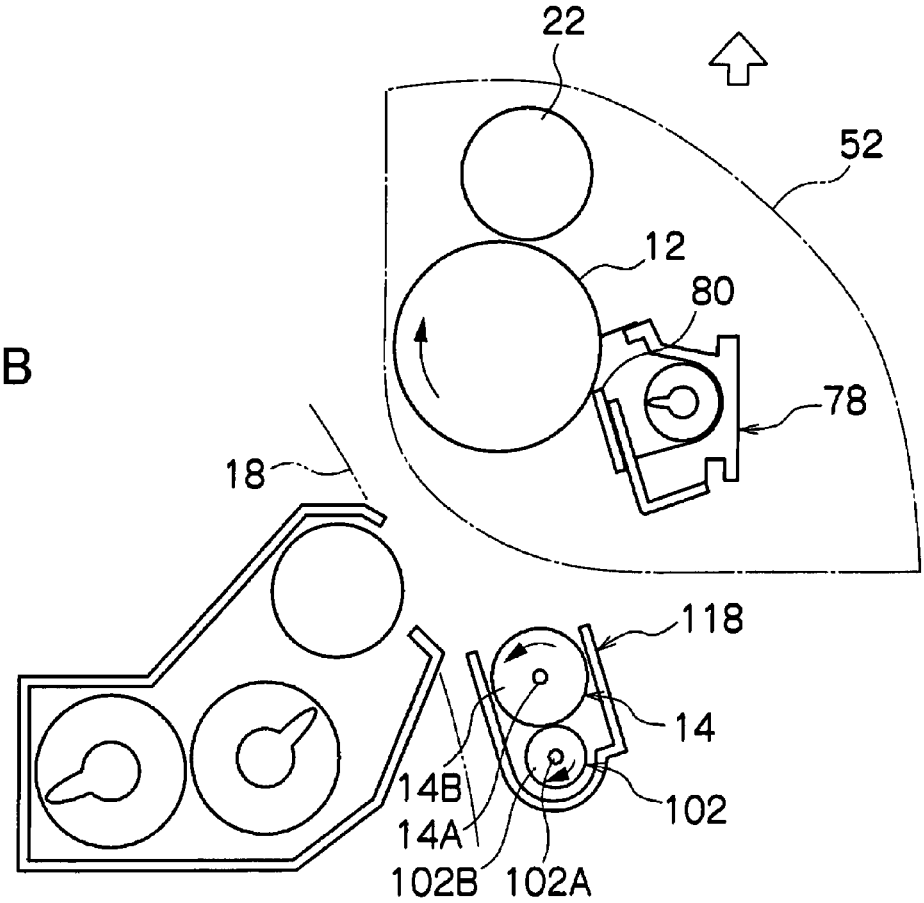
FIG. 8B is a side elevational view from an axial direction showing the positional relation between the image forming unit, and the charging roll and the cleaning roll, and shows a state in which the image forming unit is taken out from the image forming apparatus.

In accordance with the above-described structure, when the photosensitive drum 12 is replaced, the upper cover 54 of the image forming apparatus 10 is opened as shown in FIG. 2, and the image forming unit 52 is taken out from the main body of the image forming apparatus 10 as shown in FIGS. 2 and 7B. Further, as shown in FIGS. 5 and 7C, the photosensitive drum 12 is brought out in a rightward direction in the drawing, and is detached from the image forming unit 52.

Next, a description will be given of a mounting structure of the charging roll 14 and the cleaning roll 102.

Figure 6A:
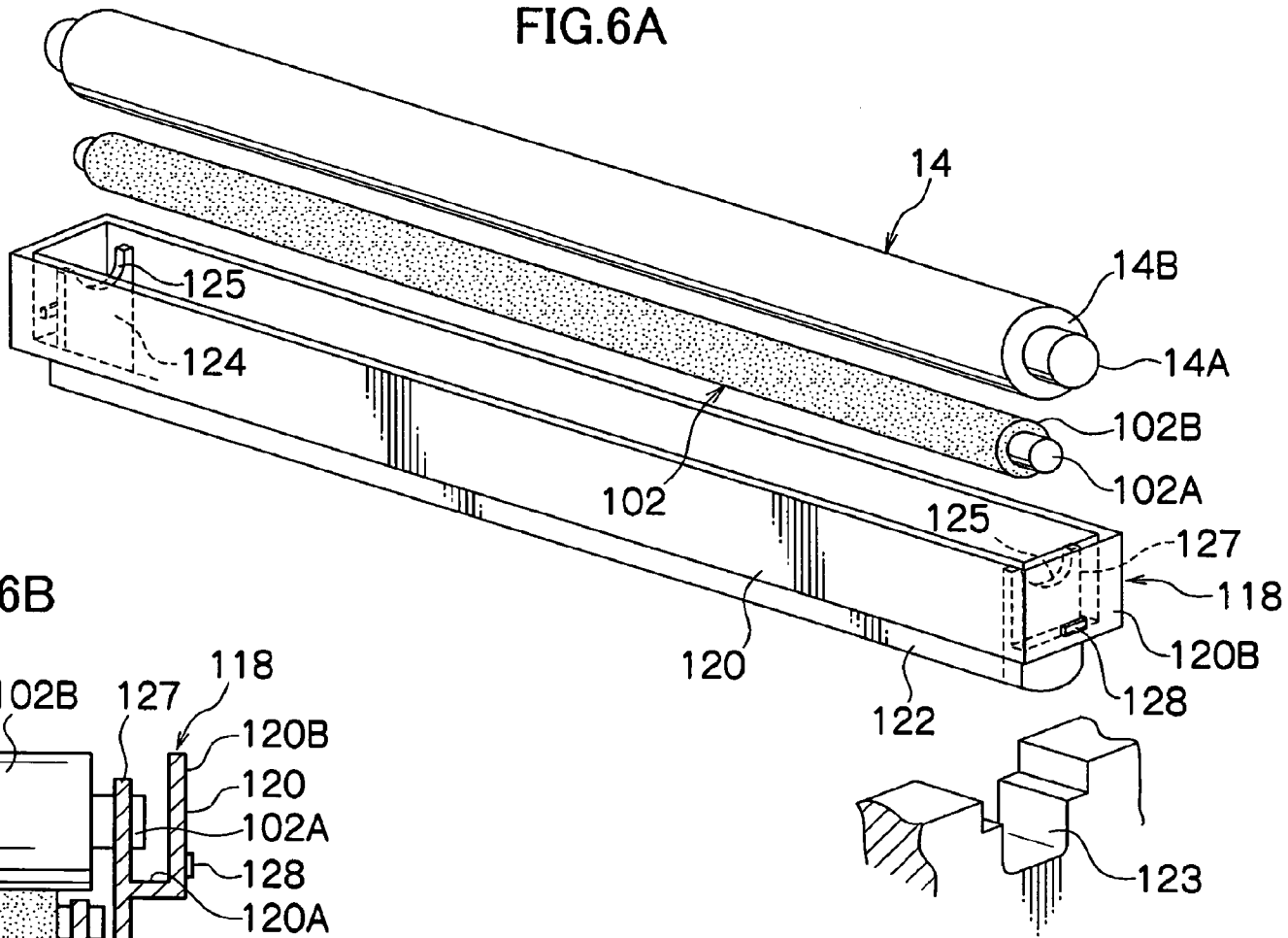
FIG. 6A is an exploded perspective view showing the mounting structure of the charging roll and the cleaning roll.
Figure 6B:
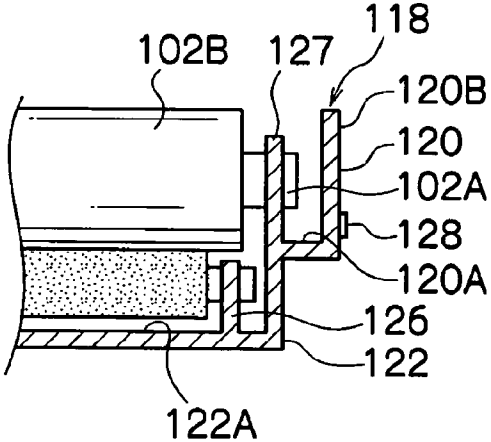
FIG. 6B is a partial side elevational view showing the mounting structure of the charging roll and the cleaning roll.

As shown in FIGS. 6A and 6B, the charging roll 14 and the cleaning roll 102 are accommodated in the approximately rectangular box-shaped housing 118. The housing 118 is structured as a two-stages structure by a large accommodation portion 120, and a small accommodation portion 122 provided in a lower side of the large accommodation portion 120 and being one size smaller than the large accommodation portion 120. The large accommodation portion 120 and the small accommodation portion 122 are fitted to a step portion 123 formed in the main body frame so as to be positioned.

The structure is made such that the charging roll 14 is accommodated in the large accommodation portion 120. Plate-shaped support pieces 127 are provided in a rising manner in both sides in a longitudinal direction of a protruding portion 120A of the large accommodation portion 120. A circular arc-shaped notch 125 is formed in the support piece 127, and the shaft 14A of the charging roll 14 is rotatably supported thereto.

Further, a bottom surface 122A of the small accommodation portion 122 is formed in a circular arc shape, and a cleaning roll 102 is accommodated therein. Plate-shape support pieces 126 are provided in a rising manner in both sides in a longitudinal direction of the bottom surface 122A. A circular arc-shaped notch is formed in the same manner as the support piece 127 in the support piece 126, and the shaft 102A of the cleaning roll 102 is rotatably supported thereto.

Rectangular convex pieces 128 are provided in a protruding manner in both side walls 120B of the large accommodation portion 120. The convex piece 128 is structured so as to be engaged with the U-shaped groove 121 (refer to FIG. 5) formed in the support member 112 of the photosensitive drum 12. The photosensitive drum 12 and the charging roll 14 are positioned on the basis of the engagement of the convex piece 128 with the groove 121 of the support member 112.

In other words, when the image forming unit 52 is installed into the image forming apparatus 10, the groove 121 formed in the support member 112 is engaged with the convex piece 128 provided in the housing 118. Accordingly, the image forming unit 52 can be installed into the image forming apparatus 10 in a state the photosensitive drum 12 is positioned with respect to the charging roll 14.

In accordance with the above-described structure, when replacing the charging roll 14 and the cleaning roll 102, the upper cover 54 of the image forming apparatus 10 is first opened so as to detach the image forming unit 52 from the image forming apparatus 10 main body, as shown in FIG. 2. Further, the structure is made such that the charging roll 14 and the cleaning roll 102 are replaced outside the apparatus by pulling up the housing 118 so as to detach from the inner side of the image forming apparatus 10.

Accordingly, as shown in FIGS. 7A to 7C, 8A and 8B, even if the image forming unit 52 is detached from the image forming apparatus 10 main body at the time of replacing the photosensitive drum 12, the charging roll 14 and the cleaning roll 102 remain within the image forming apparatus 10 main body but are not taken out from the image forming apparatus 10 main body together with the image forming unit 52. Therefore, it is possible to prevent the charging roll 14 and the cleaning roll 102 from being replaced together with the photosensitive drum 12 having the shorter service life than that of the charging roll and the cleaning roll 102. Accordingly, it is possible to use the charging roll 14 and the cleaning roll 102 up to the end of their service lives.

Further, since the charging roll 14 and the cleaning roll 102 are supported within the housing 118 independently provided from the frame 53 of the image forming unit 52 in which the photosensitive drum 12 is supported, the structure is made such that the charging roll 14 and the cleaning roll 102 are not included in the image forming unit 52. Accordingly, the image forming unit 52 is reduced in size and cost.

Further, since the charging roll 14 and the cleaning roll 102 are accommodated in the box-shaped housing 118, the dirt on the surface of the charging roll 14 removed by the cleaning roll 102 is received by the housing 118. Therefore, there is no risk that the inner side of the image forming apparatus 10 is soiled.

The timing of replacing the charging roll 14 and the cleaning roll 102 is determined in correspondence to various process conditions. In the present embodiment, the timing of replacing the charging roll 14 and the cleaning roll 102 is determined in accordance with the process conditions listed up as follows. Further, the structure is made such as to prompt a user to replace the charging roll 14 and the cleaning roll 102 by a display panel 11, at the replacing timing of the charging roll 14 and the cleaning roll 102.

For example, the structure is made such that an image density is calculated on the basis of image information, and the image density is accumulated by a control portion (not shown) incorporated in the image forming apparatus 10 main body. Then, if the accumulation of the image density exceeds a predetermined value, the charging roll 14 and the cleaning roll 102 are replaced.

Alternatively, a time during which the electric voltage is applied to the charging roll 14 from the power source apparatus 110 is counted by the control portion. Then, if the accumulation of the application time of the electric voltage of the power source apparatus 110 exceeds a predetermined value, the charging roll 14 and the cleaning roll 102 are replaced.

Alternatively, the control portion counts a number of rotations of the photosensitive drum 12, a number of rotations of the developing device 18, an exposure time of the exposure apparatus 16 and a number of sheets of the recording paper 24 on which the image is recorded, and if the accumulated value exceeds a predetermined value, the charging roll 14 and the cleaning roll 102 are replaced.

Alternatively, a timing of replacing the charging roll 14 and the cleaning roll 102 is determined by detecting an environment or the like (a temperature and a humidity) under which the image forming apparatus 10 is installed, by using a temperature and relative humidity meter, or on the basis of an image forming speed.

In the present embodiment, the structure is made such that the housing 118 in which the charging roll 14 and the cleaning roll 102 are accommodated is taken out from the image forming apparatus 10 main body, by opening the upper cover 54 of the image forming apparatus 10. However, the structure may be made such that the charging roll 14 and the cleaning roll 102 are taken out from the image forming apparatus 10 main body, by opening a side surface cover of the image forming apparatus 10, and pulling out the housing 118 to a side surface side (toward a near-side direction in FIG. 1) of the image forming apparatus 10.

Second Exemplary Embodiment

Next, a description will be given of an image forming apparatus in accordance with a second exemplary embodiment of the invention. A description of the same portions as those of the first exemplary embodiment will be omitted.

Figure 9:
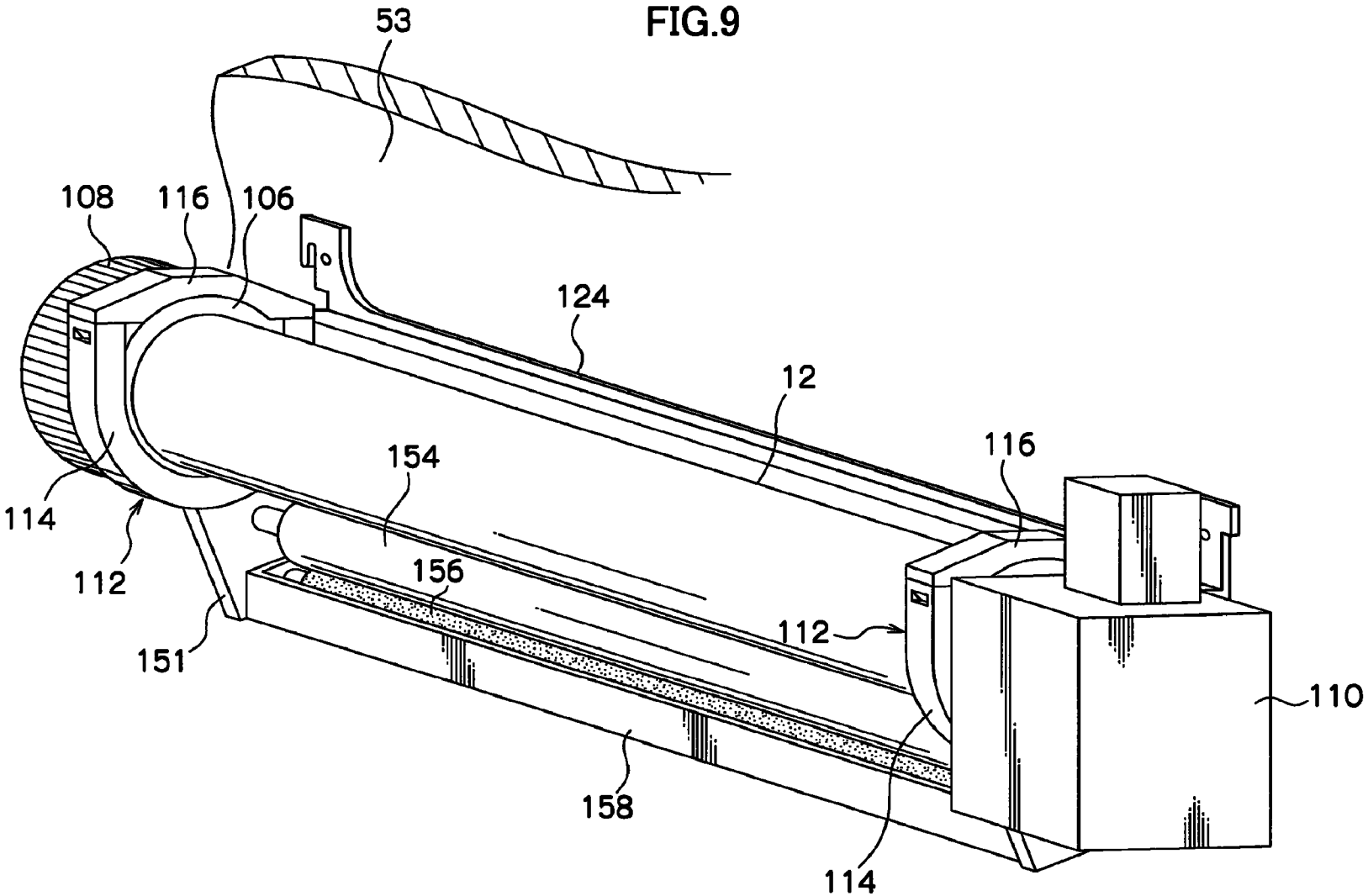
FIG. 9 is a perspective view showing a mounting structure of a photosensitive drum, a charging roll and a cleaning roll mounted to an image forming apparatus in accordance with a second exemplary embodiment of the invention.
Figure 10:
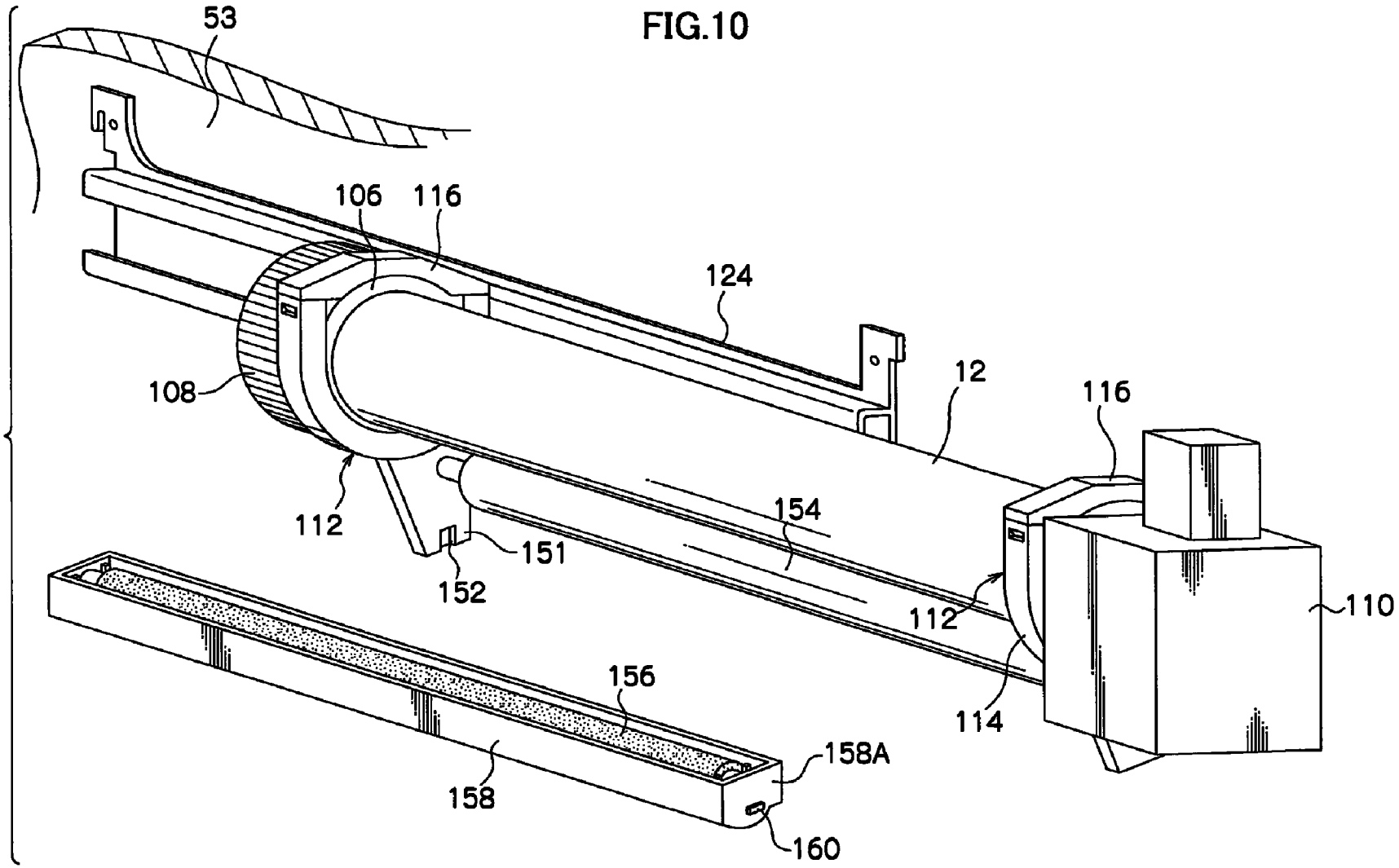
FIG. 10 is a perspective view showing the mounting structure of the photosensitive drum, the charging roll and the cleaning roll.

As shown in FIGS. 9 and 10, a plate-shaped plate piece 151 is integrally provided in the support member 112 supporting the photosensitive drum 12, and a charging roll 154 is rotatably supported to the plate piece 151. Further, an approximately U-shaped groove 152 is formed near a lower end of the plate piece 151. A protruding piece 160 provided in a housing 158 to be mentioned below is engaged with the groove 152.

A cleaning roll 156 is accommodated within an approximately rectangular box-shaped housing 158 in a rotatable state.

Rectangular convex pieces 160 are provided in a protruding manner in both side walls 158A of the housing 158. The convex piece 160 is structured so as to be engaged with the groove 152 formed in the plate piece 151, and the cleaning roll 156 is positioned on the basis of the engagement of the convex piece 160 with the groove 152.

Figures 11A, 11B, 11C:
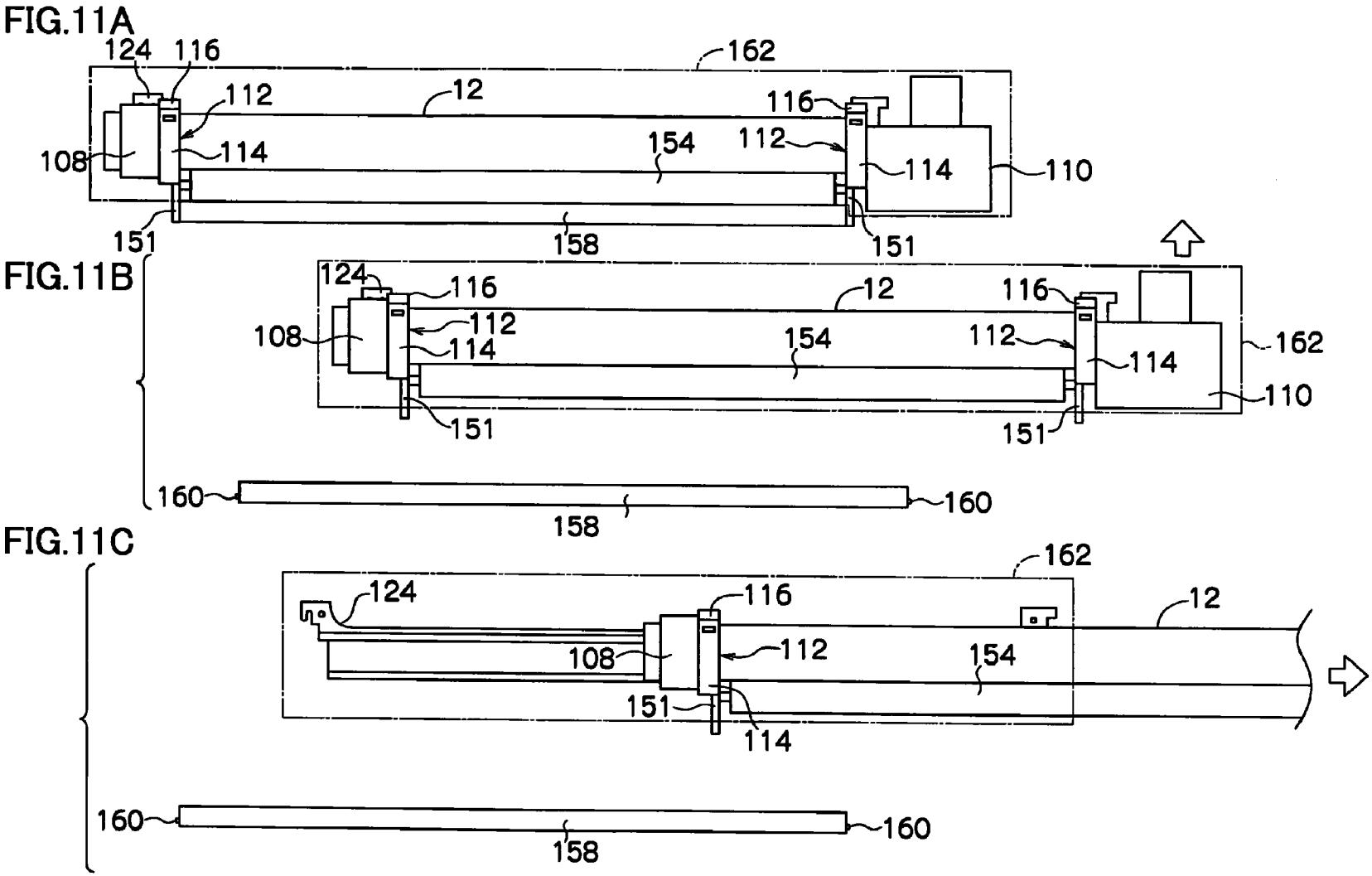
FIG. 11A is a side elevational view showing a positional relation between an image forming unit, and the charging roll and the cleaning roll, and shows a state in which the image forming unit is installed into the image forming apparatus.
FIG. 11B is a side elevational view showing the positional relation between the image forming unit, and the charging roll and the cleaning roll, and shows a state in which the image forming unit is taken out from the image forming apparatus.
FIG. 11C is a side elevational view showing the positional relation between the image forming unit, and the charging roll and the cleaning roll, and shows a state in which the photosensitive drum is detached from the image forming unit.
Figure 12A:
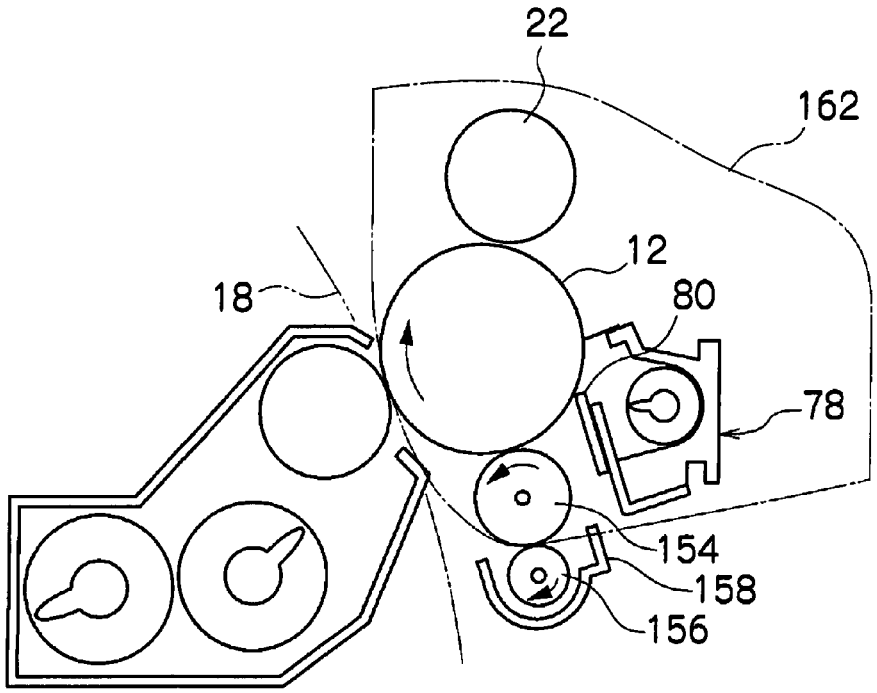
FIG. 12A is a side elevational view from an axial direction showing the positional relation between the image forming unit, and the charging roll and the cleaning roll, and shows a state in which the image forming unit is installed into the image forming apparatus.
Figure 12B:
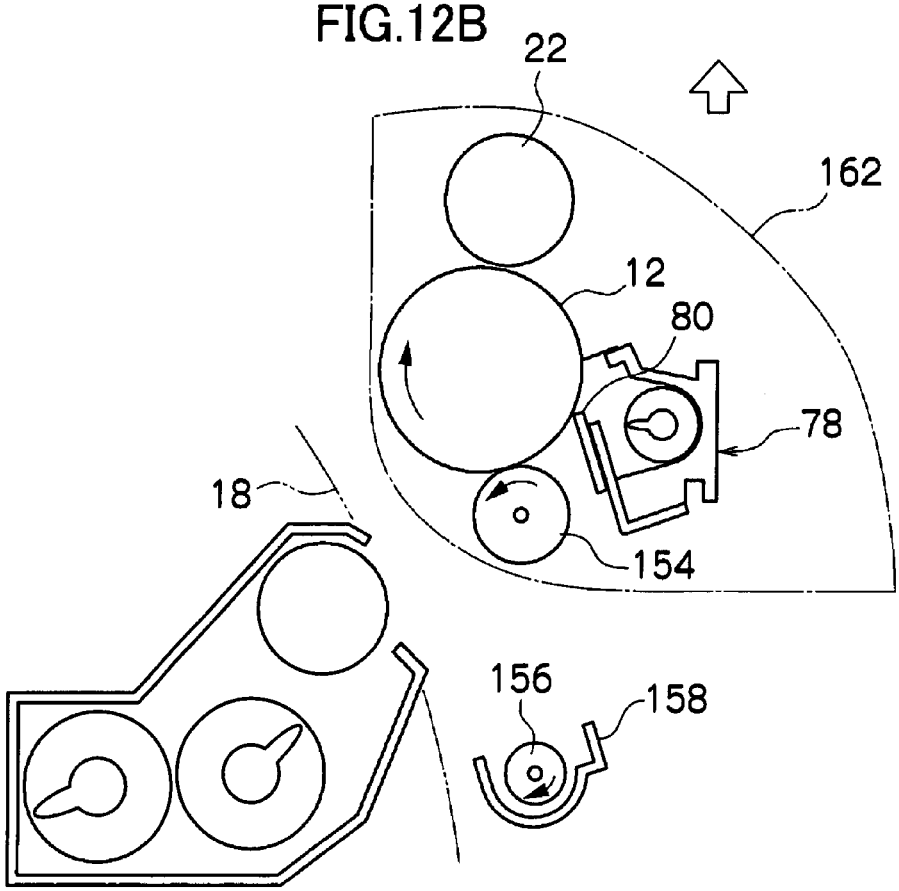
FIG. 12B is a side elevational view from an axial direction showing the positional relation between the image forming unit, and the charging roll and the cleaning roll, and shows a state in which the image forming unit is taken out from the image forming apparatus.

In accordance with the above-mentioned structure, when the cleaning roll 156 is replaced, the upper cover 54 (refer to FIG. 2) of the image forming apparatus 10 is opened, and the image forming unit 162 is taken out from the inner side of the image forming apparatus 10 main body, as shown in FIGS. 11B and 12B. Further, as shown in FIGS. 10 and 11C, the photosensitive drum 12 is drawn out in a rightward direction in the drawing, and is taken out from the image forming unit 162. At this time, the charging roll 154 is also taken out together with the photosensitive drum 12, and is detached from the image forming unit 162.

Further, the structure is made such that the cleaning roll 156 is replaced outside the apparatus by pulling up the housing 158 so as to detach from the inner side of the image forming apparatus 10.

Accordingly, as shown in FIG. 12B, even if the image forming unit 162 is taken out from the image forming apparatus 10 main body at the time of replacing the photosensitive drum 12, the cleaning roll 156 remains within the image forming apparatus 10 main body but is not taken out from the image forming apparatus 10 main body together with the image forming unit 162. Accordingly, it is possible to prevent the cleaning roll 156 from being replaced together with the photosensitive drum 12 having the shorter service life than that of the cleaning roll 156. Therefore, it is possible to use the cleaning roll 156 up to the end of its service life.

Further, since the cleaning roll 156 is supported within the housing 158 independently provided from the frame 53 of the image forming unit 162 to which the photosensitive drum 12 and the charging roll 154 are supported, the structure is made such that the cleaning roll 156 is not included in the image forming unit 162. Accordingly, the image forming unit 52 is downsized so as to be inexpensively structured.

Third Exemplary Embodiment

Next, a description will be given of an image forming apparatus in accordance with a third exemplary embodiment of the invention. A description of the same portions as those of the first exemplary embodiment will be omitted.

Figure 13:
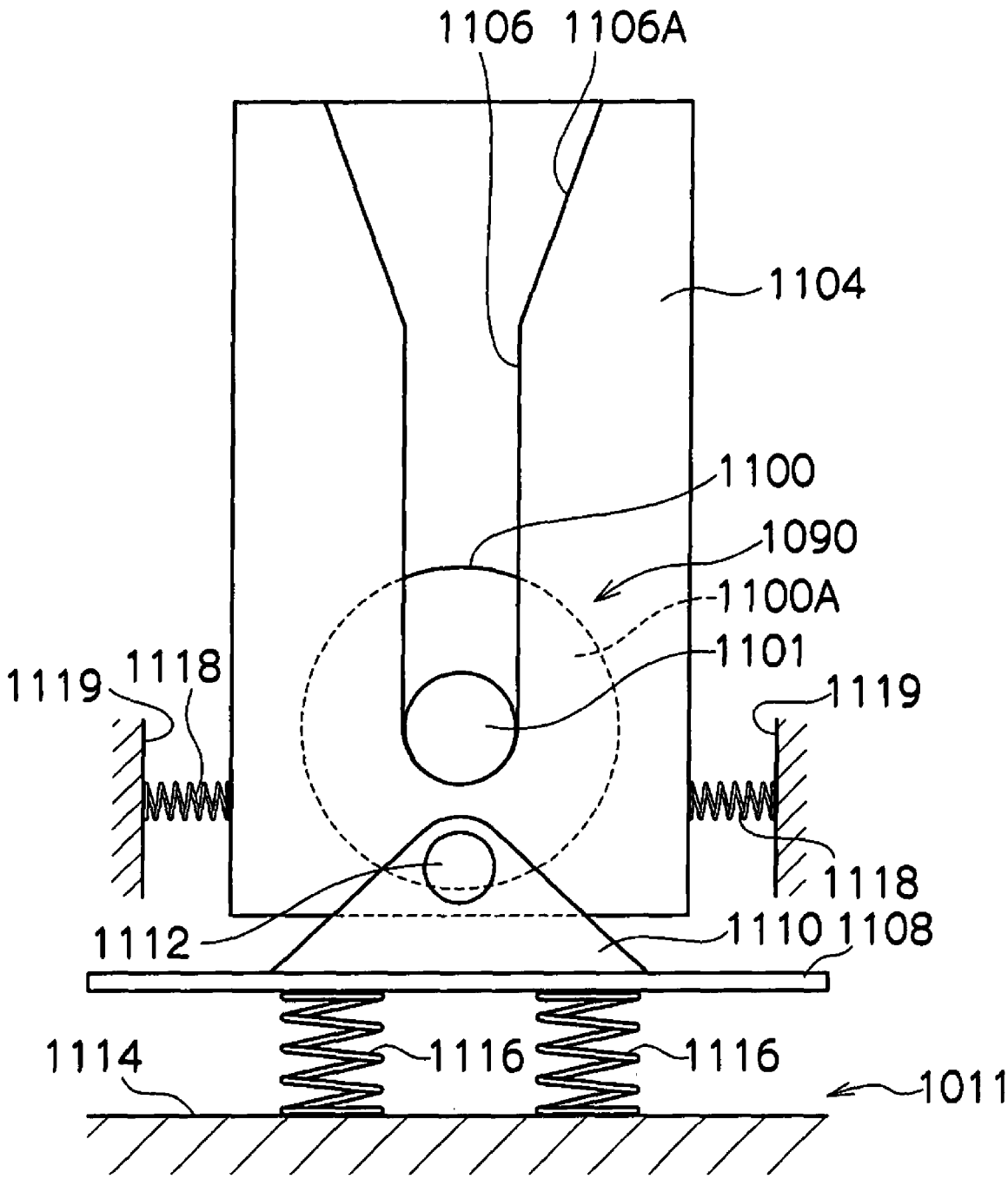
FIG. 13 is a schematic view illustrating a configuration of cleaning roll and portions near guide groove of at image forming apparatus main body.
Figure 14:
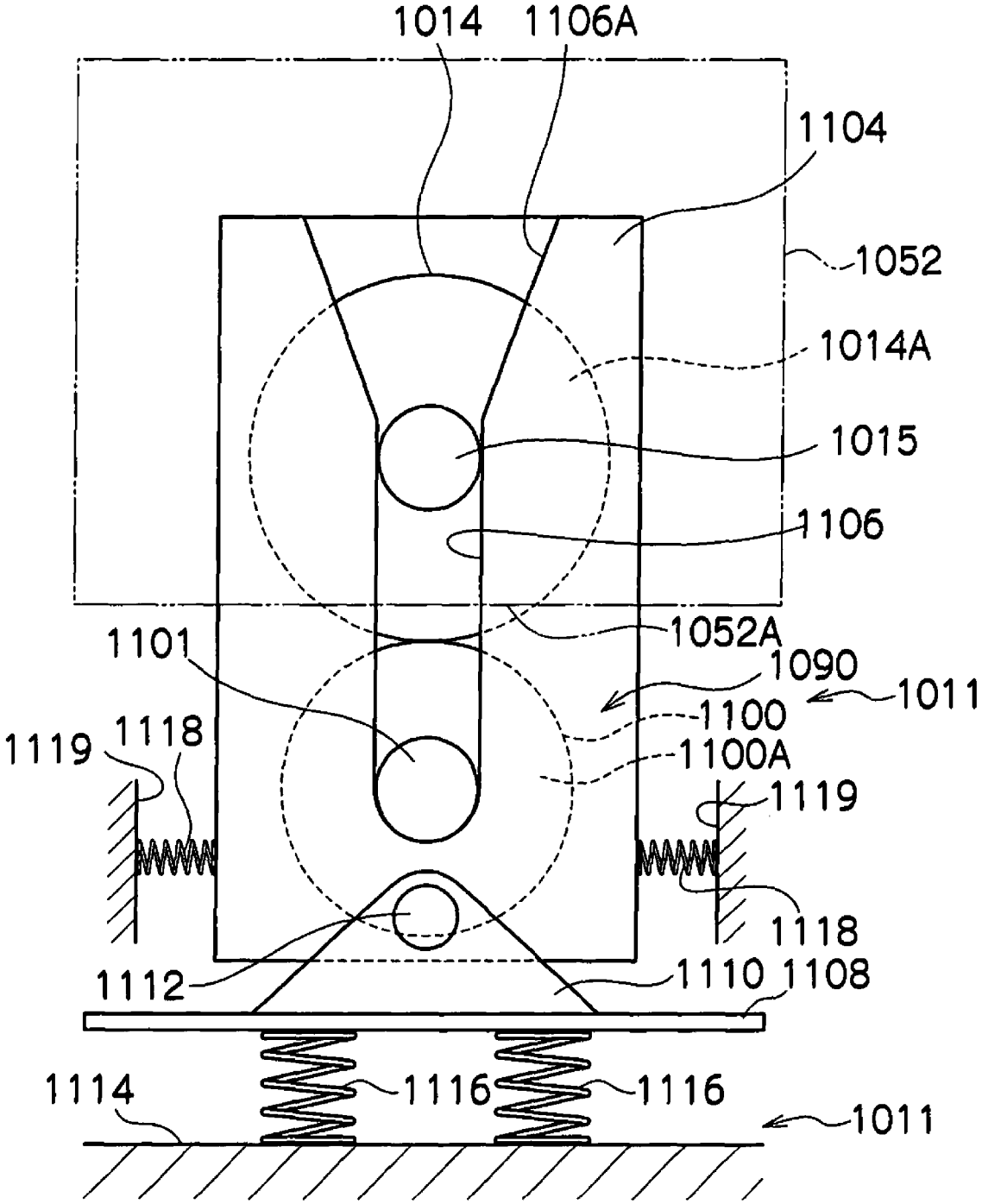
FIG. 14 is a schematic view illustrating a state in which a shaft of charging roll of a process cartridge is inserted along guide groove at image forming apparatus main body.

FIG. 13 illustrates a configuration of cleaning device 1090 mounted at image forming apparatus main body 1011. FIG. 14 illustrates a configuration of charging, roll 1014 and cleaning device 1090 when process cartridge 1052 is mounted at image forming apparatus main body 1011.

As shown in FIG. 14, exposure portion 1052A, which exposes a part of the peripheral surface of charging roll 1014 in a longitudinal direction, is formed at process cartridge 1052. Further, cleaning roll 1100 provided at cleaning device 1090 is disposed inside image forming apparatus main body 1011 at a position opposing exposure portion 1052A of process cartridge 1052 mounted at image forming apparatus main body 1011.

As shown in FIG. 13, cleaning roll 1100 has sponge layer 1100A formed around shaft 1101. Shaft 1101 is rotatably supported by guide groove 1106, which is a substantially U-shaped opening formed in shaft receiving member 1104. Tapered surfaces 1106A are formed at an upper part of guide groove 1106 such that the width of guide groove 1106 gradually increases.

Further, support plate 1108 is disposed at a position opposing a lower part of shaft receiving member 1104, and projections 1110 that project upwards are formed at both end portions of support plate 1108. Support shaft 1112, which is fixed to shaft receiving member 1104, is rotatably supported by the projections 1110, and shaft receiving member 1104 is able to oscillate around support shaft 1112 toward the left-hand and right-hand side of the drawing. Multiple coil springs 1116 are provided at a lower part of support plate 1108 between support plate 1108 and base 1114, which is fixed to image forming apparatus 1011. For example, four coil springs 1116 are provided, one at each of the four corners of support plate 1108.

Further, coil springs 1118 are provided between shaft receiving member 1104 and the frame of image forming apparatus 1011 at either side of shaft receiving member 1104 in the direction of rotation. The configuration is such that when shaft receiving member 1104 rotates, it is restored to its original position by the elastic restorative force of coil springs 1118.

As shown in FIG. 14, charging roll 1014 has charging layer 1014A formed around shaft 1015 and shaft 1015 is rotatably supported by the frame (not shown) of process cartridge 1052.

Here, cleaning roll 1100 is explained in detail.

Free-machining steel, stainless steel or the like are used as the material of shaft 1101 of cleaning roll 1100, and the material and surface treatment method are appropriately selected according to the application in view of slidability and the like. Non-conductive materials may be processed with a commonly-used treatment such as plating treatment and thus imparted with conductivity or, of course, used as is. Further, in order that cleaning roll 1100 contacts charge roll 1014 via sponge layer 1100A with an appropriate amount of nip force, a material that is strong enough not to bend when nipping, or a shaft diameter having sufficient rigidity with respect to the shaft length, is selected.

Sponge layer 1100A is formed from foam having a porous three-dimensional structure with cavities and irregularities (referred to as "cells" in the following) inside and on the surface thereof, and has elasticity. The material of sponge layer 1100A is selected from foamable resin or rubber such as polyurethane, polyethylene, polyamide, olefin, melamine or polypropylene, NBR, EPDM, natural rubber and styrene butadiene rubber, chloroprene, silicone or nitrile. As a result, a sponge layer 1100A having multiple cells can be manufactured at low cost. In order that sponge layer 1100A effectively cleans extraneous material such as external additives by being driven by contact with charge roll 1014 and, at the same time, in order that the surface of charging roll 1014 is not scratched by the rubbing of sponge layer 1100A and that erosion or damage are not caused over the long-term, a polyurethane having strong tearing and tensile strength and the like may be used.

The material for the sponge layer 1100A is not particularly limited to polyurethane as long as it includes a reaction between polyols such as polyester polyol, polyether polyester and acrylic polyol, isocyanates such as 2,4-tolylenediisocyanate, 2,6-tolylenediisocyanate, 4,4-diphenylmethanediisocyanate, tolidinediisocyanate, 1,6-hexamethylenediisocyanate, and is preferably mixed with a chain extender such as 1,4-butanediol or trimethylolpropane. Further, foam is commonly formed by using a foaming agent such as water or an azo compound such as azodicarboxylicamide or azobisisobutylonitryl. In addition, auxiliary agents such as a foaming auxiliary agent, foam regulating agent, or a catalyst may be added as necessary.

The number of cells in cleaning roll 1100 is preferably 40-80/25 mm, and more preferably 45-75/25 mm. When the number of cells is set to within these ranges, it becomes easier for toner or extraneous material such as external additives to be absorbed within the cells and for the absorbed extraneous material such as external additives to be transferred to charging roll 1014 and photosensitive drum 1012 (this phenomenon is described in the following). When the number of cells is greater than 80/25 mm, the absorbance of external additives is reduced due to small cell diameter and, on the other hand, when the number of cells is fewer than 40/25 mm, cell diameter becomes too large and it becomes difficult to aggregate a sufficient amount of external additives to be transferred to the charging roll 1014.

Further, the diameter of cleaning roll is preferably from ϕ7 mm to ϕ14 mm, and more preferably from ϕ8 mm to ϕ13 mm, and the radial thickness of sponge layer is preferably from 2 mm to 4 mm. When the diameter is larger than 14 mm, since the number of times that one location at the peripheral surface of cleaning roll 1100 contacts the external additive is reduced and, further, the number of times of cleaning is reduced, this is disadvantageous from the perspective of miniaturization of an object that is superior in long-term stability with respect to cleaning properties. When the diameter is smaller than 7 mm, while this is excellent in terms of enabling miniaturization of an image forming apparatus, since the number of times that one location at the peripheral surface contacts the external additive is increased and, further, the number of times of cleaning is increased, this is disadvantageous with respect to long-term stability.

Next, charging roll 1014 is explained in detail.

Charging roll 1014 has a conductive elastic layer as charging layer 1014A and a surface layer formed in this order on conductive shaft 1015.

The diameter of charging roll 1014 is from ϕ7 mm to ϕ15 mm, and more preferably from ϕ8 mm to ϕ14 mm. When the diameter is larger than 15 mm, since the number of times that one location at the peripheral surface contacts the external additive is reduced and, further, the number of times of electrical discharge is reduced, this is disadvantageous from the perspective of miniaturization of an object that is superior in long-term stability with respect to contamination and charging properties. When the diameter is smaller than 7 mm, while this is excellent in terms of enabling miniaturization of image forming apparatus 1010, since the number of times that one location at the peripheral surface of contacts the external additive is increased and, further, the number of times of electrical discharge is increased, this is disadvantageous with respect to long-term stability.

The configuration of charging roll 1014 is not particularly limited to the following as long as it has specific charging properties.

Free-machining steel, stainless steel or the like are used as the material of shaft 1015, and the material and surface treatment method are appropriately selected according to the application in view of slidability and the like. Non-conductive materials are processed with a commonly-used treatment such as plating treatment and thus imparted with conductivity.

The above-described conductive elastic layer constituting charging layer 1014A of charging roll 1014 may have materials that can normally be added to rubber added thereto, such as an elastic material such as rubber having elasticity, a conductive material such as carbon black or an ion conductive material for regulating the resistance of the conductive elastic layer and, as needed, a softener, a plasticizer, a curing agent, a vulcanizing agent, a vulcanization accelerator, an antiaging agent, a filling agent such as silica or calcium carbonate. A composite having added thereto a material that is normally added to rubber is formed by coating around the peripheral surface of conductive shaft 1015. A dispersed material that electrically conducts electrons and/or ions as charge carriers, such as carbon black arranged in a matrix or an ion conductive agent, may be used as a conductive agent for regulating the resistance value. Further, the above elastic material may be a foamed body.

The elastic material constituting the above-described conductive elastic layer is, for example, formed by dispersing a conductive agent inside a rubber material. Examples of the rubber material include isoprene rubber, chloroprene rubber, epichlorohydrin rubber, butyl rubber, urethane rubber, silicone rubber, fluororubber, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylic nitrile-butadiene copolymer rubber, natural rubber or blended rubbers thereof. Among these, silicone rubber, ethylene-propylene rubber, epichlorohydrin-ethylene oxide copolymer rubber, epichlorohydrin-ethylene oxide-allylglycidyl ether copolymer rubber, acrylic nitrile-butadiene copolymer rubber, or blended rubbers thereof are preferably used as the rubber material. These rubbers materials may be foamed materials or foamless materials.

Electron conductive agents or ion conductive agents can be used as the conductive agent. Examples of the electron conductive agent include a fine powder of: a carbon black such as ketchen black or acethylene black; pyrolytic carbon or graphite; conductive metals or alloys such as aluminum, copper, nickel or stainless steel; conductive metal oxides such as stannic oxide, indium oxide, titanium oxide, stannic oxide-antimony oxide solid solution or stannic oxide-indium oxide solid solution; and insulating materials having had surface conductivity treatment. Further, examples of the ion conductive agent include chlorates or perchlorates such as tetraethylammonium or lauryltrimethylammonium; and chlorates or perchlorates of alkali earth metals or alkali metals such as lithium or magnesium.

The surface layer constituting part of charging layer 1014A is formed in order to prevent contamination by extraneous material such as toner, and any resin or rubber or the like may be used as the material of the surface layer without any particular limitation. Examples thereof include polyester, polyimide, copolymer nylon, silicone resin, acrylic resin, polyvinylbutyral, ethylenetetrafluoroethylene copolymer, melamine resin, fluororubber, epoxy resin, polycarbonate, polyvinylalcohol, cellulose, polyvinylidene chloride, polyethylene, and ethylene-vinyl acetate copolymer. In view of contamination by external additives polyvinylidene-fluoride, tetrafluoroethylene copolymer, polyester, polyimide and copolymer nylon are preferably used.

A conductive material can be included in the surface layer and the resistance value can be regulated. It is advisable that the particle diameter of the conductive material is 3 μm or less. Further, a dispersed material that electrically conducts electrons and/or ions as charge carriers, such as an ion conductive agent, conductive metal oxide particles or carbon black arranged in a matrix, may be used as a conductive agent for regulating the resistance value.

A fluorine or silicone resin may be used in the surface layer. In particular, it is preferably structured by a fluorine-modified acrylate polymer. Further, fine particles may be added within the surface layer. As a result of this, the surface layer becomes hydrophobic which acts to prevent extraneous material from attaching to charging roll 1014. It is also possible to add insulating particles such as of alumina or silica, provide the surface of charging roll 1014 with irregularities, reduce the load during abrasion with photosensitive drum 1012, and improve the mutual resistance to wear of charging roll 1014 and photosensitive drum 1012.

Next, the mechanism of image forming device 1010 having the structure described above is explained.

As shown in FIG. 14, when process cartridge 1052 is mounted at image forming apparatus main body 1011, shaft 1015 of charging roll 1014 is inserted along guide groove 1106 of shaft receiving member 1104 provided at image forming apparatus main body 1011. Tapered surfaces 1106A are formed at the upper part of guide groove 1106 such that the width of guide groove 1106 is increased, and shaft 1015 can be inserted by sliding against tapered surface 1106A. Here, since shaft receiving member can oscillate around support shaft 1112 to the left-hand and right-hand sides of the drawing, guide groove 1106 oscillates toward the direction of insertion of shaft 1015. As a result, shaft 1015 can be easily inserted. Further, even if shaft receiving member 1104 oscillates, shaft receiving member 1104 returns to its original position due to the elastic restorative force of coil springs 1118.

When shaft 1015 is inserted into guide groove 1106, charging layer 1014A of charging roll 1014 contacts sponge layer 1100A of cleaning roll 1100. Here, cleaning roll 1100 contacts charging roll 1014 with predetermined pressure and a nip portion is formed.

In this kind of image forming apparatus 1010, since cleaning roll 1100 is provided at image forming apparatus main body 1011, cleaning roll 1100 is not replaced together with process cartridge 1052 and, as well as being possible to prevent increases in cost and waste materials, simplification and miniaturization of process cartridge 1052 are made possible. Further, since cleaning roll 1100 is not included in process cartridge 1052, charging roll 1014 and cleaning roll 1100 are not in contact during storage of process cartridge 1052 and it is thus possible to prevent a nip imprint from forming on charging roll 1014. As a result, generation of image irregularities can be suppressed.

Further, by inserting shaft 1015 of charging roll 1014 along guide groove 1106, shaft 1015 and shaft 1101 of cleaning roll 1100 are mutually positioned, as a result of which it is possible to prevent variations in the positional relationship between charging roll 1014 and cleaning roll 1100 when process cartridge 1052 is mounted at image forming apparatus main body 1011, and the nip portion of both rolls can be prevented from becoming uneven. As a result, it is possible to perform stable cleaning of charging roll 1014 even if there are variations in tolerance.

Since support plate 1108 below shaft receiving member 1104 is supported with coil springs 1116, the impact due to contact when shaft 1015 of charging roll 1014 is inserted is absorbed. Further, since the contact pressure between charging roll 1014 and cleaning roll 1100 is regulated by the weight of charging roll 1014 and coil springs 1116, fluctuations in tolerance are absorbed and an approximately constant contact pressure is maintained between charging roll 1014 and cleaning roll 1100 (constant load system). As a result, it is possible to perform cleaning with charging roll 1014 stabilized at a constant pressure.

Figure 15:
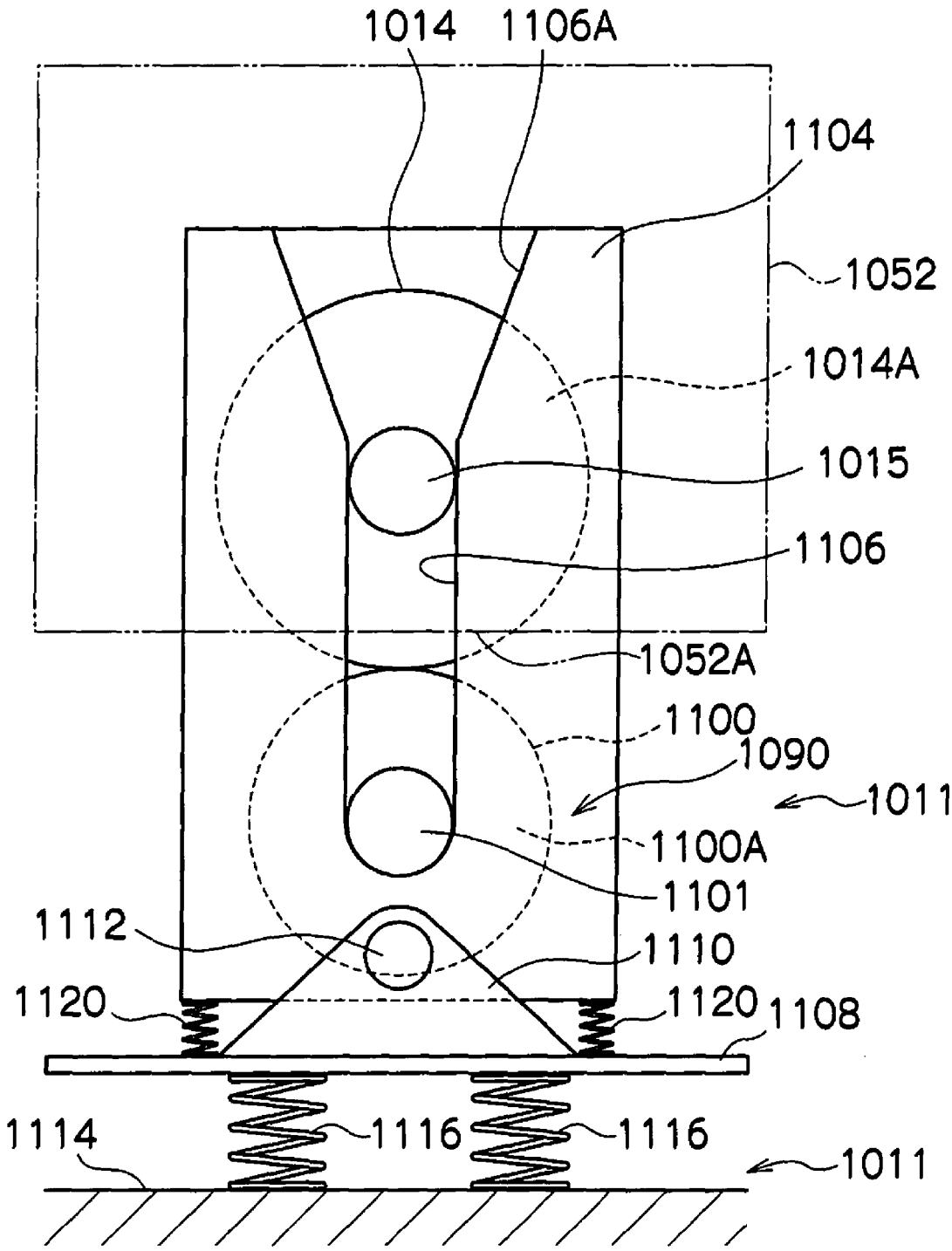
FIG. 15 is a schematic view illustrating a variation of configuration of cleaning roll and portions near guide groove shown in FIG. 14.

Further, as shown in FIG. 15, multiple coil springs 1120 may be provided between shaft receiving member 1104 and support plate 1108. For example, coil springs 1120 can be provided at the four corners of the bottom surface of shaft receiving member 1104. As a result, even if shaft receiving member 1104 oscillates when shaft 1015 of charging roll 1014 is inserted into guide groove 1106, shaft receiving member 1104 can be easily returned to its original position by the elastic restorative force of coil springs 1120.

Figure 16:
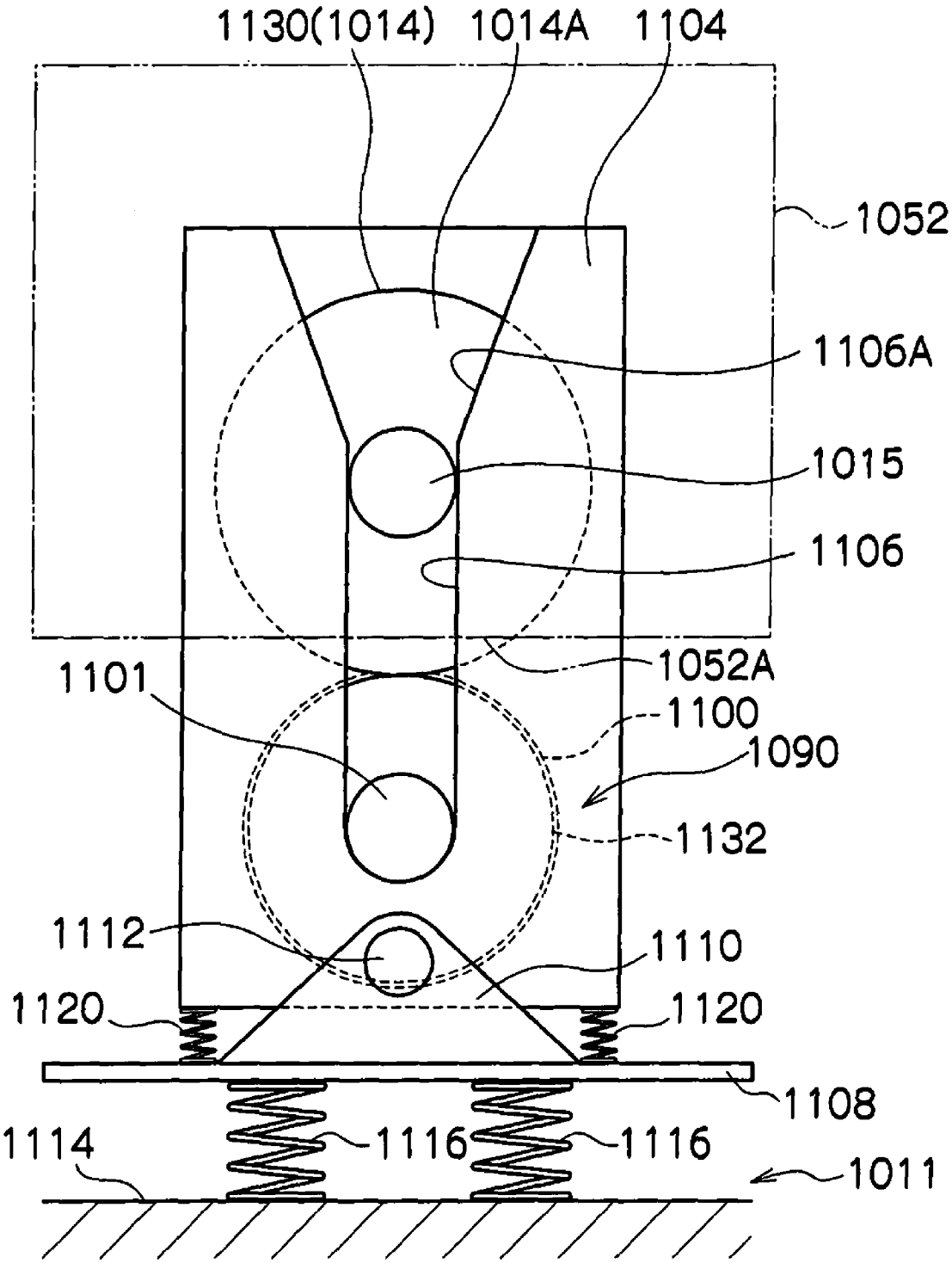
FIG. 16 is a schematic view illustrating another variation of configuration of cleaning roll and portions near guide groove shown in FIG. 14.
Figure 17:
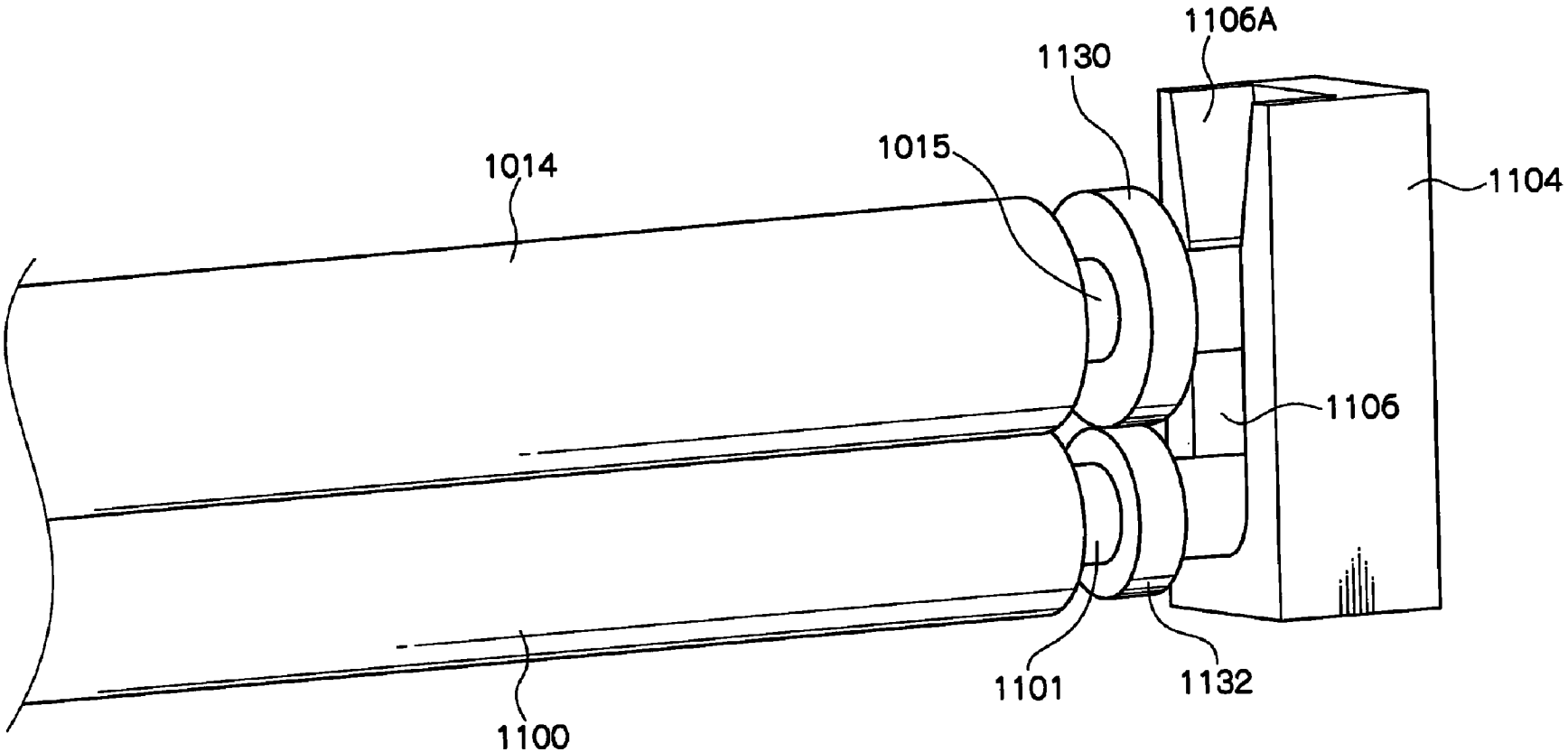
FIG. 17 is a perspective view illustrating the configuration of cleaning roll and portions near guide groove shown in FIG. 16.

Further, as shown in FIGS. 16 and 17, gap regulating rolls 1130 having approximately the same diameter as charging roll 1014 can be provided at either end portion of charging roll 1014 and gap regulating rolls 1132 having a slightly smaller diameter (for example, a diameter 2 mm smaller) than the diameter of cleaning roll 1100 can be provided at either end of shaft 1101 of cleaning roll 1100. When process cartridge 1052 is mounted at image forming apparatus main body 1011, that is, when shaft 1015 of charging roll 1014 is inserted into guide groove 1106 of shaft receiving member 1104, a constant nip amount is maintained between charging roll 1014 and cleaning roll 1100 (fixed displacement system). As a result, it is possible to stabilize the cleaning properties of cleaning roll 1100 with respect to charging roll 1014. Further, fluctuations in tolerance can be absorbed by coil springs 1116 supporting support plate 1108 of shaft receiving portion 1104.

In addition, instead of the structure of FIGS. 16 and 17, the diameter of gap regulating rolls 1130 may be made smaller than the diameter of charging roll 1014 (for example, 2 mm smaller) or the diameters of gap regulating rolls 1130 and gap regulating rolls 1132 may be made smaller than the diameters of charging roll 1014 and cleaning roll 1100 (for example, both 1 mm smaller). As a result, a constant nip amount is maintained between charging roll 1014 and cleaning roll 1100 (fixed displacement system).

Fourth Exemplary Embodiment

Next, a fourth exemplary embodiment of the image forming apparatus of the present invention is explained. In addition, components that are the same as in the first exemplary embodiment are given the same reference numbers and explanation thereof is not repeated.

Figure 18:
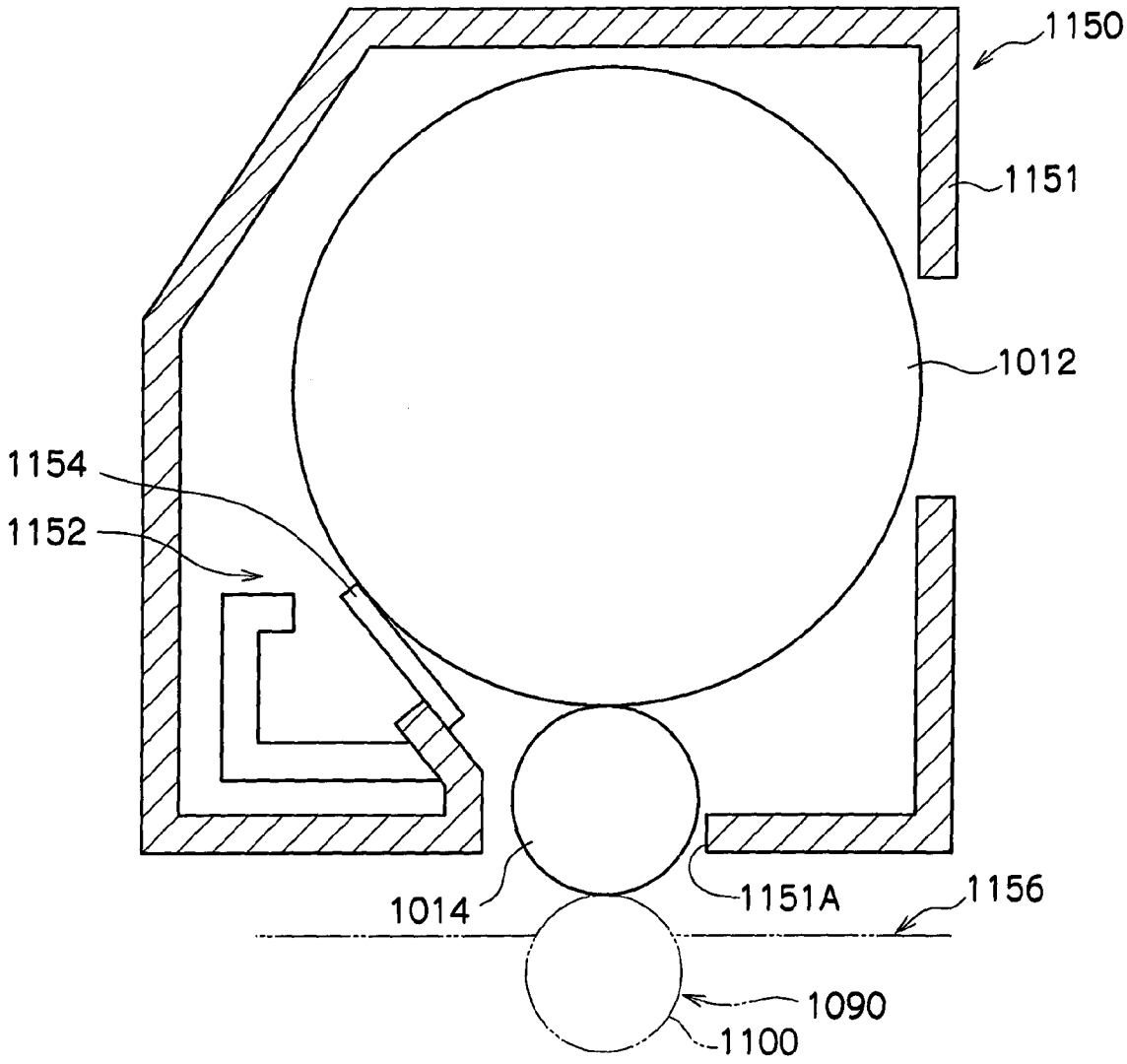
FIG. 18 is a schematic view illustrating a process cartridge used at an image forming apparatus of the fourth exemplary embodiment.

As shown in FIG. 18, in this image forming apparatus, removable process cartridge 1150 is provided at image forming apparatus 1156. Photosensitive drum 1012 and charging roll 1014, which contacts photosensitive drum 1012, are provided inside casing 1151 of process cartridge 1150. Exposure portion 1151A is formed at casing 1151, which exposes a portion of the peripheral surface of charging roll 1014 in a longitudinal direction. In addition, cleaning device 1152 that cleans the surface of photosensitive drum 1012 is provided inside casing 1151, and cleaning blade 1154 of cleaning device 1152 contacts the surface of photosensitive drum 1012.

Cleaning roll 1100 that cleans the surface of charging roll 1014 is not provided at process cartridge 1150; rather, cleaning roll 1100 is provided at image forming apparatus main body 1156. Cleaning roll 1100 is provided at a position opposing exposure portion 1151A of process cartridge 1150 when process cartridge 1150 is mounted at image forming apparatus main body 1156, and is configured such that cleaning roll 1100 contacts the peripheral surface of charging roll 1014 exposed at exposure portion 1151A.

Figure 19:
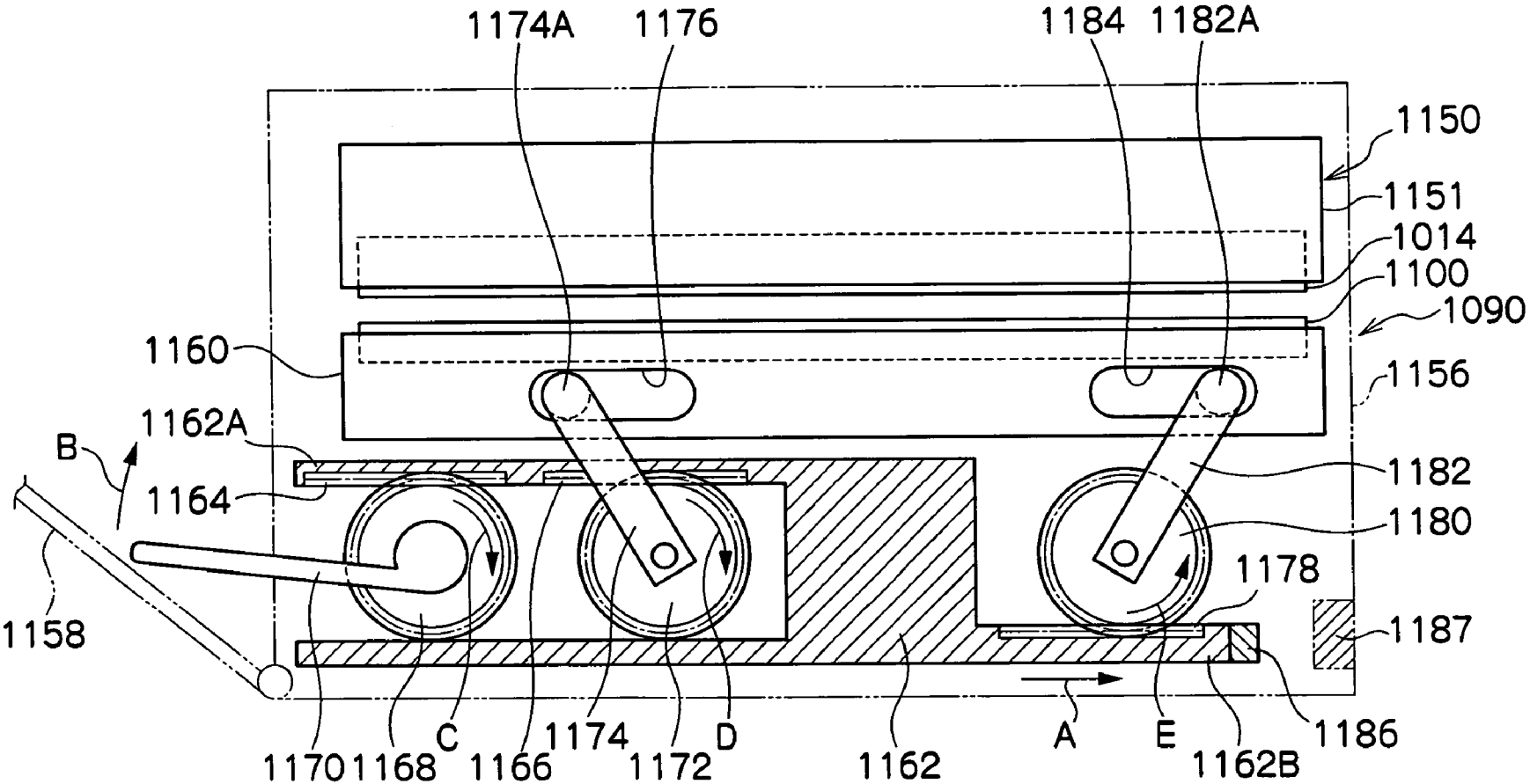
FIG. 19 is a schematic view illustrating an operation of mounting the process cartridge shown in FIG. 8 to the image forming apparatus main body and illustrating a state in which the charging roll and the cleaning roll are separated.

As shown in FIG. 19, main body-side unit 1160 is provided as a support member at image forming apparatus main body 1156, and cleaning roll 1100 is supported by main body-side unit 1160. Process cartridge 1150 is removably disposed above main body-side unit 1160. Process cartridge 1150 is mounted at image forming apparatus main body 1156 by opening cover 1158 of image forming apparatus main body 1156 and sliding process cartridge into image forming apparatus main body 1156 along a guide portion (not shown) from the left-hand side of the drawing.

Sliding member 1162 is disposed below main body-side unit 1160 as a moving unit that is slidable in a left-right direction (the direction of Arrow A in FIG. 19) along a rail (not shown) inside image forming apparatus main body 1156. Gear parts (racks) 1164, 1166 are formed at a lower portion of plate part 1162A that extends from an upper part of sliding member 1162.

Gear 1168, which is rotatably supported at image forming apparatus main body 1156, is engaged with gear part 1164 at the side of cover 1158, and handle 1170 is attached to gear 1168 as a movable part. Gear 1172, which is rotatably supported at image forming apparatus main body 1156, is engaged with the inner side gear part 1166. Arm 1174 is attached to the axis of rotation of gear 1172 as an elevation unit, and arm 1174 rotates integrally with the rotation of gear 1172. Projection 1174A is formed folded into an L-shape at the distal end of arm 1174, and projection 1174A is inserted into long hole 1176 formed in a left-right direction at main body-side unit 1160, and is movable inside long hole 1176.

Gear part (rack) 1178 is formed at an upper part of plate part 1162B that extends from a lower part of sliding member 1162. Gear 1180, which is rotatably supported at image forming apparatus main body 1156, is engaged with gear part 1178. Arm 1182 is attached to the axis of rotation of gear 1180 as an elevation unit, and arm 1182 rotates integrally with the rotation of gear 1180. Projection 1182A is formed folded into an L-shape at the distal end of arm 1182, and projection 1182A is inserted into long hole 1184 formed in a left-right direction at main body-side unit 1160, and is movable inside long hole 1184.

Magnet 1186 is provided at an end part at the inner side (the opposite side from handle 1170) of sliding member 1162, and magnet 1187 is provided at image forming apparatus main body 1156 so as to oppose magnet 1186. When sliding member 1162 is moved to an inner side thereof (the opposite side from handle 1170), magnet 1186 and magnet 1187 are attracted together and movement of sliding member 1162 is restricted.

Figure 20:
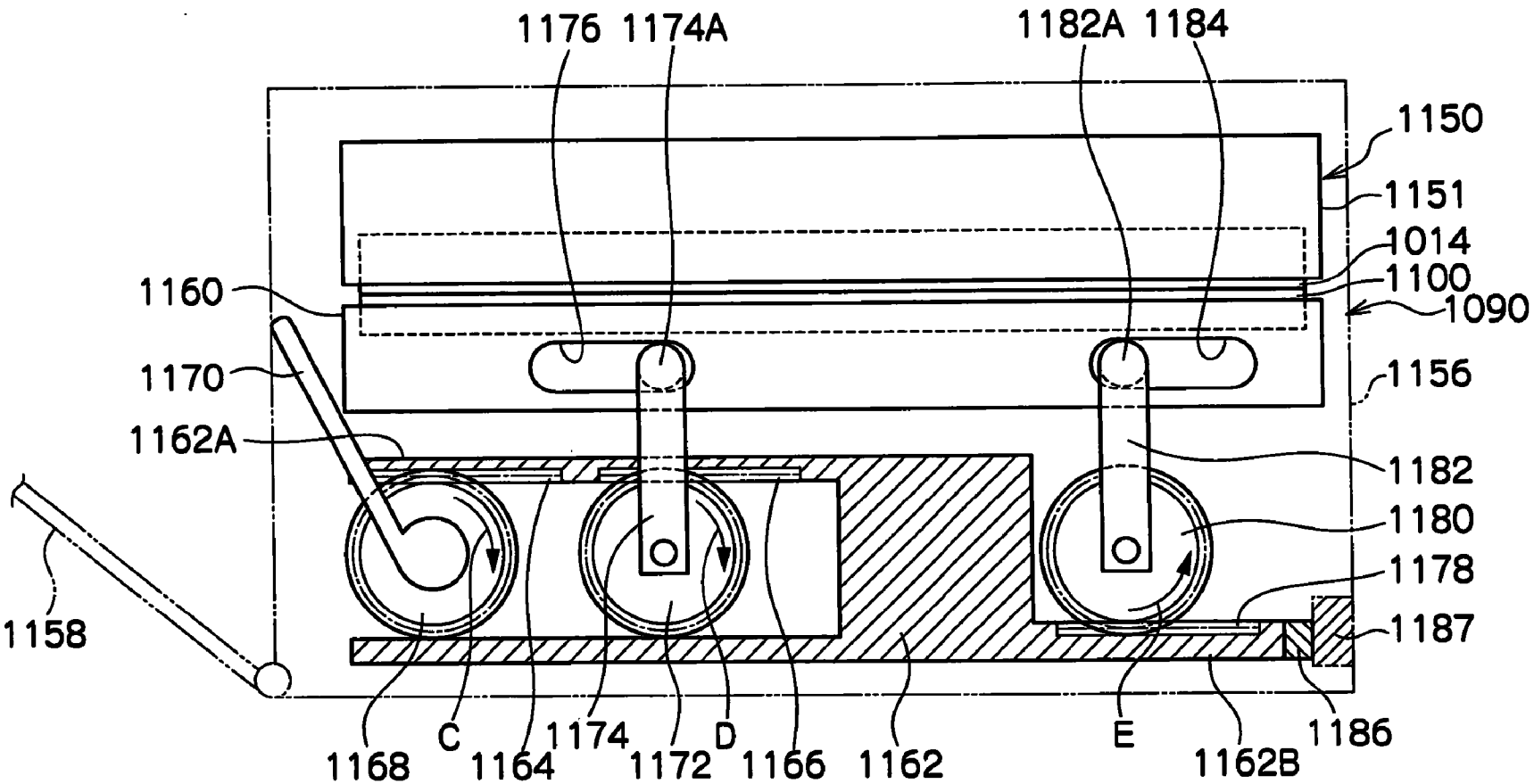
FIG. 20 is a schematic view illustrating an operation of mounting the process cartridge shown in FIG. 8 to the image forming apparatus main body and illustrating a state in which the charging roll contacts the cleaning roll.

In this kind of image forming apparatus, after cover 1158 is opened and process cartridge 1150 is mounted at image forming apparatus main body 1156 along a guide portion (not shown), handle 1170 is rotated upward (in the direction of Arrow B), whereupon gear 1168 connected to handle 1170 rotates in the direction of Arrow C and sliding member 1162, which is provided with gear part 1164 engaged with gear 1168, moves in the direction of Arrow A. When sliding member 1162 moves in the direction of Arrow A, gear 1172 engaged with gear part 1166 rotates in the direction of Arrow D and gear 1180 engaged with gear part 1178 rotates in the direction of Arrow E. Then, as shown in FIG. 20, arm 1174 rotates with the rotation of gear 1172 in the direction of Arrow D, arm 1182 rotates with the rotation of gear 1180 in the direction of Arrow E, and projection 1174A of arm 1174 moves long hole 1176 and projection 1182A of arm 1182 moves long hole 1184 to push up main body-side unit 1160. As a result, main body-side unit 1160 is contiguous with process cartridge 1150 and cleaning roll 1100 contacts charging roll 1014. Thereafter, mounting of process cartridge 1150 at image forming apparatus main body 1156 is completed by closing cover 1158.

On the other hand, in order to separate process cartridge 1150 and main body-side unit 1160, it suffices to open cover 1158 and lower the raised handle 1170. This causes gear 1168 to rotate in the direction opposite to Arrow C, sliding member 1162 to move toward the left-hand side of the drawing (the direction opposite to Arrow A), and gears 1172, 1180 to rotate in directions opposite to FIG. 20. The two arms 1174, 1182 rotate due to the rotation of gears 1172, 1180 to push down main body-side unit 1160. As a result, charging roll 1014 of process cartridge 1150 and cleaning roll 1100 of main body-side unit 1160 are separated, and process cartridge 1150 can be easily replaced.

In addition, in the present embodiment, sliding member 1162 is moved by rotary operation of handle 1170; however, as long as the configuration is such that sliding member 1162 is moved in response to the movement of a movable part, the movement of the movable part is not limited to rotary operation and can be appropriately determined.

Fifth Exemplary Embodiment

Next, a fifth exemplary embodiment of the image forming apparatus of the present invention is explained. In addition, components that are the same as in the first and second exemplary embodiments are given the same reference numbers and explanation thereof is not repeated.

Figure 21:
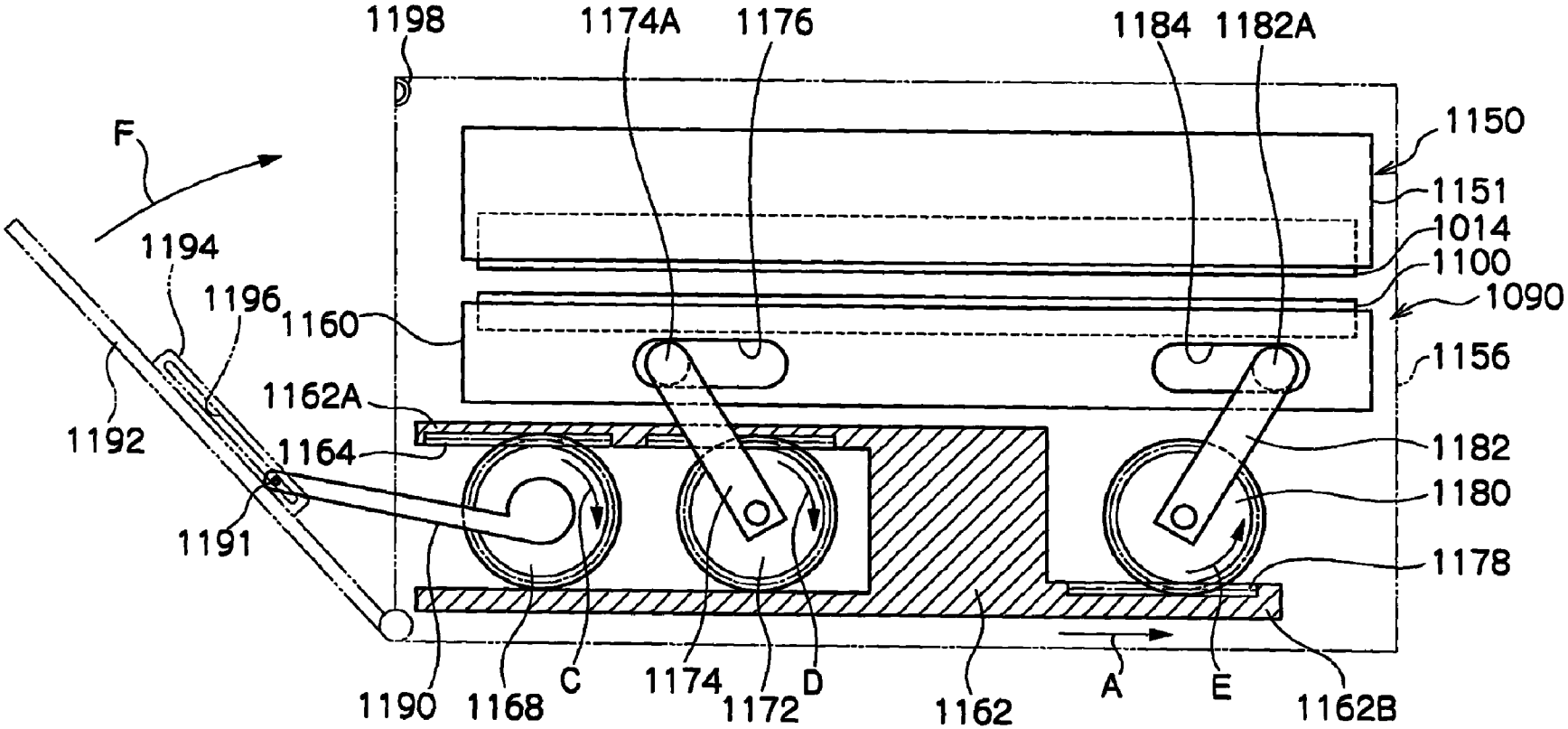
FIG. 21 is a schematic view illustrating an operation of mounting the process cartridge used at an image forming apparatus of the fifth exemplary embodiment to the image forming apparatus main body and illustrating a state in which the charging roll and the cleaning roll are separated.

As shown in FIG. 21, in the image forming apparatus, pin 1191 is provided in a perpendicular direction at the distal end of handle 1190 connected to gear 1168. Further, projecting piece 1194 is provided in a vertical direction at an inner side of cover 1192 of image forming apparatus main body 1156, and slide hole 1196 is formed in a vertical direction at projecting piece 1194. Pin 1191 at the distal end of handle 1190 is slidably engaged with slide hole 1196, with a configuration such that pin 1191 can slide at slide hole 1196 in conjunction with the opening and closing of cover 1192. Further, stopper 1198 that locks cover 1192 when cover 1192 is closed is provided at an upper part of image forming apparatus main body 1156.

Figure 22:
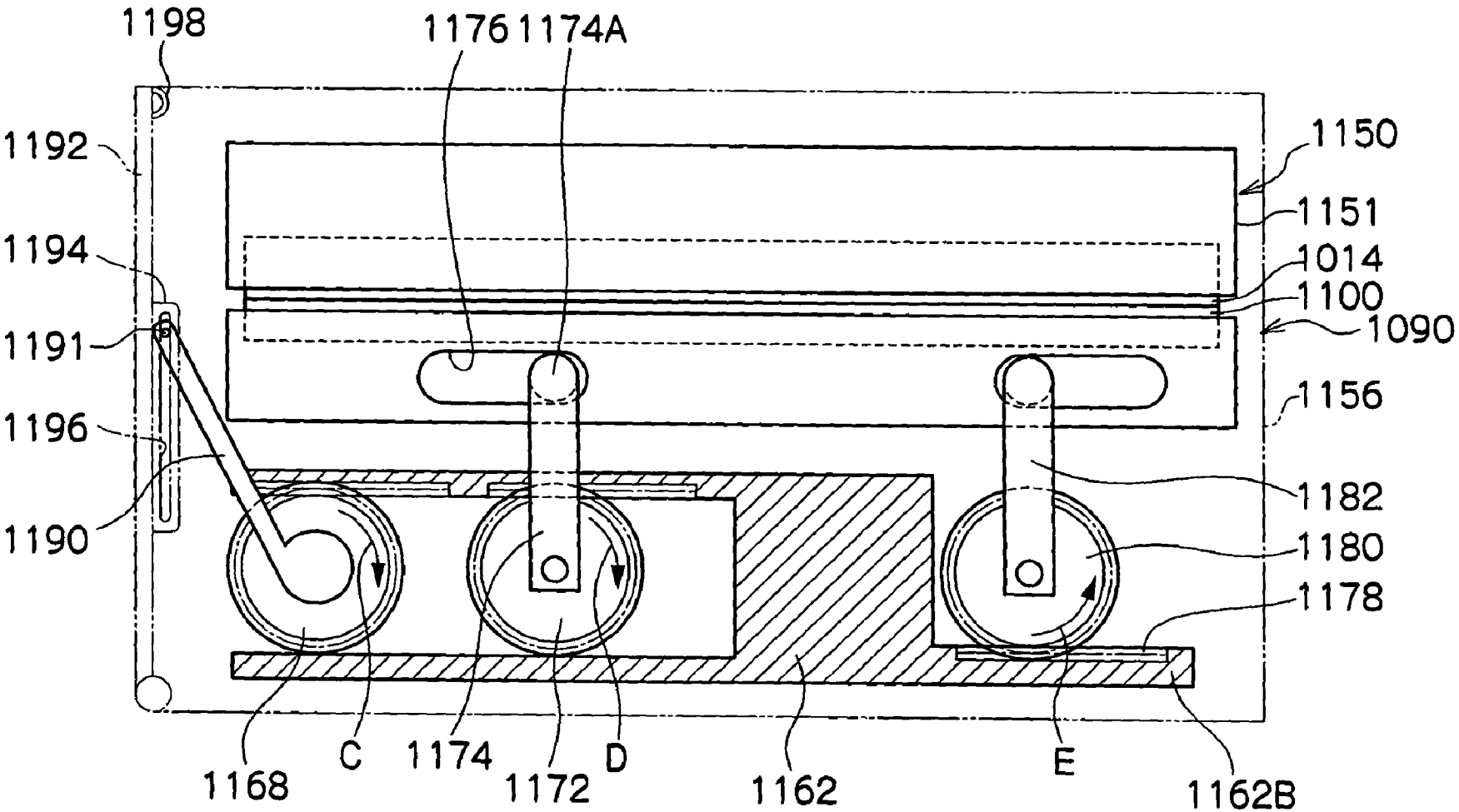
FIG. 22 is a schematic view illustrating an operation of mounting the process cartridge shown in FIG. 21 to the image forming apparatus main body and illustrating a state in which the charging roll contacts the cleaning roll.

In this kind of image forming apparatus, cover 1192 is closed in the direction of Arrow F after process cartridge 1150 is mounted at image forming apparatus main body 1156. This causes pin 1191 at the distal end of handle 1190 to move to the top of slide hole 1196, handle 1190 to rotate upward, and gear 1168 to rotate in the direction of Arrow C with the rotation of handle 1190. Sliding member moves in the direction of Arrow A due to the rotation of gear 1168, and gear 1172 rotates in the direction of Arrow D and gear 1180 rotates in the direction of Arrow E. As a result, arms 1174, 1182 stand and push up main body-side unit 1160 as shown in FIG. 22, and charging roll 1014 of process cartridge 1150 and cleaning roll 1100 contact.

Further, when cover 1192 is opened, pin 1191 at the distal end of handle 1190 moves to the bottom of slide hole 1196, handle 1190 rotates downward, and gear 1168 rotates in the opposite direction to Arrow C with the rotation of handle 1190. Sliding member 1162 moves in the opposite direction to Arrow A due to the rotation of gear 1168, and gears 1172, 1180 rotate in directions opposite to FIG. 12. As a result, arms 1174, 1182 rotate and push down main body-side unit 1160, and charging roll of process cartridge 1150 is separated from cleaning roll 1100. In this state, process cartridge 1150 can be easily replaced.

In this kind of image forming apparatus, since main body-side unit moves downward or upward in response to an opening or closing operation of cover 1192, charging roll 1014 and cleaning roll 1100 can be contacted and separated by a simple operation.

Further, the configuration of the image forming apparatus shown in FIGS. 19 and 20 is such that main body-side unit 1160 is moved to the process cartridge 1150 side; however, the configuration is not limited to this. It is possible to adopt a structure in which, for example, process cartridge 1150 is moved to main body-side unit 1160 using a movement means such as a cam to make charging roll 1014 of process cartridge 1150 contact cleaning roll 1100 of main body-side unit 1160.

Further, image forming apparatus 1010 shown in FIG. 1 is configured to perform formation of a toner image on a photosensitive drum in four repeated cycles using a rotary development apparatus; however, the invention is not limited to this configuration. The present invention may also be applied to a configuration in which, for example, yellow, magenta, cyan and black image forming units are provided in a row along the direction of movement of an intermediate transfer belt.

In accordance with the first aspect of the invention, the image carrier is detachably held to the apparatus main body by the first holding portion. Further, the cleaning member cleaning the charging roll, or both of the charging roll charging the image carrier and the cleaning member are held by the second holding portion provided within the apparatus main body independently from the first holding portion.

In other words, the structure is made such that the cleaning member, or both of the charging roll and the cleaning member are held to the first holding portion having the image carrier. Accordingly, the first holding portion having the image carrier is reduced in size and cost.

Further, even if the first holding portion is taken out from the apparatus main body at a time of replacing the image carrier, the cleaning member is not taken out from the apparatus main body together with the first holding portion, but remains within the apparatus main body. Accordingly, the cleaning member is not replaced together with the image carrier having the shorter service life than that of the cleaning member. Therefore, it is possible to use the cleaning member up to the end of its service life.

In the same manner, in the case that both of the charging roll and the cleaning member are held by the second holding portion, the charging roll and the cleaning member remain within the apparatus main body and is not taken out from the apparatus main body together with the first holding portion, even if the first holding potion is taken out from the apparatus main body at a time of replacing the image carrier. Accordingly, the charging roll and the cleaning member are not replaced together with the image carrier having the shorter service life than that of the charging roll and the cleaning member. Therefore, it is possible to use the charging roll and the cleaning member up to the end of their service lives.

In accordance with a second aspect of the invention, the second holding portion may be detachably attached to the apparatus main body.

In accordance with the second aspect of the invention, the second holding portion can be attached to and detached from the apparatus main body. In other words, the charging roll and the cleaning member held to the second holding portion can be attached to and detached from the apparatus main body. Accordingly, since it is possible to replace the charging roll and the cleaning member outside the apparatus main body, it is easy to execute the replacing in a short time.

In accordance with a third aspect of the invention, the second holding portion may comprise a housing in which the cleaning member is accommodated.

In accordance with the third aspect of the invention, the cleaning member, or both of the charging roll and the cleaning member are accommodated in the housing. Accordingly, since the dirt on the surface of the charging roll removed by the cleaning member is received by the housing, there is no risk that the inner side of the apparatus is soiled.

In accordance with a fourth aspect of the invention, the charging roll and the cleaning member may be replaced on the basis of use conditions.

In accordance with the fourth aspect of the invention, the cleaning member, or both of the charging roll and the cleaning member are replaced on the basis of a process condition of the image forming apparatus. In other words, it is possible to replace the cleaning member, or both of the charging roll and the cleaning member at a time when the service life comes to the end, by calculating a replacing timing of the cleaning member, or both of the charging roll and the cleaning member on the basis of the process condition.

Since the present invention is structured as mentioned above, it is possible to use the charging roll and/or the cleaning member up to the end of the service life. Further, since the charging roll cleaner is not included in the process cartridge, the charging roll and the charging roll cleaner are not in contact with each other during storage of the process cartridge, and thus generation of a nip imprint on the charging roll can be prevented and generation of irregularities in formed images can be suppressed.

What is claimed is:

1. An image forming apparatus comprising:

an image carrier carrying an image;

a charging roll charging the image carrier;

a cleaning member configured to be brought into contact with the charging roll for cleaning the charging roll;

a first holding portion detachably provided in an apparatus main body for holding the image carrier; and a second holding portion for holding the cleaning member; wherein the first holding portion is configured to be detachable from the image forming apparatus while leaving the second holding portion in the image forming apparatus.

2. The image forming apparatus of claim 1, wherein the second holding portion is detachably attached to the apparatus main body.

3. The image forming apparatus of claim 1, wherein the charging roll is held by the first holding portion.

4. The image forming apparatus of claim 1, wherein the charging roll is held by the second holding portion.

5. The image forming apparatus of claim 1, wherein the second holding portion comprises a housing in which the cleaning member is accommodated.

6. The image forming apparatus of claim 2, wherein the second holding portion comprises a housing in which the cleaning member is accommodated.

7. The image forming apparatus of claim 1, wherein the second holding portion comprises a housing in which the charging roll and the cleaning member are accommodated.

8. The image forming apparatus of claim 1, wherein the charging roll and the cleaning member are replaced on the basis of use conditions.

9. The image forming apparatus of claim 2, wherein the charging roll and the cleaning member are replaced on the basis of use conditions.

10. The image forming apparatus of claim 1, wherein the image carrier comprises a photosensitive drum.

11. The image forming apparatus of claim 1, wherein the cleaning member comprises a rotatable cleaning roll, and the cleaning roll is brought into contact with the charging roll in such a manner that an axis of rotation of the cleaning roll is parallel with an axis of rotation of the charging roll.

12. An image forming unit detachably provided in an image forming apparatus comprising:

a first holding portion holding an image carrier carrying an image; and a second holding portion holding a charging roll charging the image carrier, and a cleaning member brought into contact with the charging roll and cleaning the charging roll, the second holding portion being detachable with respect to the first holding portion; wherein the first holding portion is configured to be detachable from the image forming apparatus while leaving the second holding portion in the image forming apparatus.

13. The image forming unit of claim 12, wherein the image carrier comprises a photosensitive drum.

14. The image forming unit of claim 12, wherein the cleaning member comprises a rotatable cleaning roll, and the cleaning roll is brought into contact with the charging roll in such a manner that an axis of rotation of the cleaning roll is parallel with an axis of rotation of the charging roll.

* * * * *